US007828422B2

(12) United States Patent
Kimura et al.

(10) Patent No.: US 7,828,422 B2
(45) **Date of Patent: *Nov. 9, 2010**

(54) LIQUID CONTAINER

(75) Inventors: Hitotoshi Kimura, Nagano (JP); Taku Ishizawa, Nagano (JP); Izumi Nozawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 138 days.

This patent is subject to a terminal disclaimer.

(21) Appl. No.: 12/109,969

(22) Filed: Apr. 25, 2008

(65) Prior Publication Data

US 2008/0218568 A1 Sep. 11, 2008

Related U.S. Application Data

(63) Continuation of application No. 10/892,765, filed on Jul. 16, 2004, now Pat. No. 7,367,662.

(30) Foreign Application Priority Data

Jul. 18, 2003 (JP) ..... 2003-199035
Feb. 6, 2004 (JP) ..... 2004-031294

(51) Int. Cl.
*B41J 2/175* (2006.01)
*B41J 2/14* (2006.01)

(52) U.S. Cl. ..... 347/86; 347/49

(58) Field of Classification Search ..... 347/49, 347/84, 85, 86
See application file for complete search history.

(56) References Cited

U.S. PATENT DOCUMENTS 4,447,820 A 5/1984 Terasawa
4,640,804 A 2/1987 Mizoguchi
4,695,824 A 9/1987 Tazaki
4,719,057 A 1/1988 Mizoguchi
5,138,344 A 8/1992 Ujita
5,157,421 A 10/1992 Kitahara
5,221,935 A 6/1993 Uzita
5,381,172 A 1/1995 Ujita et al.
5,506,611 A 4/1996 Ujita et al.
5,523,780 A 6/1996 Hirosawa
5,666,146 A 9/1997 Mochuzuki
6,022,102 A 2/2000 Ikkatai et al.
6,053,606 A 4/2000 Yamaguchi
6,062,667 A 5/2000 Matsui et al.
6,106,112 A * 8/2000 Okubo et al. ..... 347/86
6,264,314 B1 7/2001 Mochuzuki
6,264,318 B1 * 7/2001 Oda et al. ..... 347/86

(Continued)

FOREIGN PATENT DOCUMENTS

CN 1242741 1/2000

(Continued)

*Primary Examiner*—Anh T. N. Vo
(74) *Attorney, Agent, or Firm*—Stroock & Stroock & Lavan LLP

(57) ABSTRACT

A liquid container contains a liquid therein and is detachably mountable to a liquid ejection device. The liquid container has a liquid lead-out port for supplying said liquid to the outside, the liquid lead-out port being disposed in a connection surface, and an abutment surface for opening a channel valve by abutting against part of said channel valve provided in said liquid ejection device, the abutment surface being disposed in said connection surface.

6 Claims, 16 Drawing Sheets

U.S. PATENT DOCUMENTS

| | | | | |
|---|---|---|---|---|
| 6,270,210 | B1 | 8/2001 | Yamaguchi | |
| 6,281,911 | B1 | 8/2001 | Nakazawa et al. | |
| 6,283,585 | B1 | 9/2001 | Ikkatai et al. | |
| 6,312,084 | B1 | 11/2001 | Ujita et al. | |
| 6,390,611 | B1 | 5/2002 | Kobayashi et al. | |
| 6,520,630 | B1 | 2/2003 | Oda et al. | |
| 6,540,321 | B1 | 4/2003 | Hirano | |
| 6,582,068 | B2 | 6/2003 | Ishizawa et al. | |
| 6,612,689 | B2 | 9/2003 | Suenaga et al. | |
| 6,705,714 | B1 | 3/2004 | Petranek | |
| 6,742,857 | B2 | 6/2004 | Koshikawa et al. | |
| 6,742,872 | B2 | 6/2004 | Fukazawa et al. | |
| 6,755,500 | B2 | 6/2004 | Hirano | |
| 6,783,218 | B2 | 8/2004 | Cheok | |
| 6,793,332 | B2 | 9/2004 | Kaga et al. | |
| 6,796,635 | B2 | 9/2004 | Shinada | |
| 6,832,830 | B2 | 12/2004 | Seino et al. | |
| 6,834,945 | B2 | 12/2004 | Ishizawa et al. | |
| 6,843,558 | B2 | 1/2005 | Seino | |
| 6,874,876 | B2 | 4/2005 | Ishizawa et al. | |
| 6,908,182 | B2 * | 6/2005 | Nakazawa et al. | 347/86 |
| 6,945,639 | B2 | 9/2005 | Lee | |
| 6,976,746 | B2 | 12/2005 | Shimamura | |
| 7,018,029 | B2 | 3/2006 | Ishizawa et al. | |
| 7,052,121 | B2 | 5/2006 | Yamada | |
| 7,380,909 | B2 | 6/2008 | Ishizawa et al. | |
| 7,452,062 | B2 | 11/2008 | Kimura et al. | |
| 7,566,120 | B2 | 7/2009 | Ishizawa et al. | |
| 2001/0024225 | A1 | 9/2001 | Ishizawa et al. | |
| 2002/0196312 | A1 | 12/2002 | Ishizawa et al. | |
| 2003/0067521 | A1 | 4/2003 | Kaga et al. | |
| 2003/0222940 | A1 | 12/2003 | Seino et al. | |

FOREIGN PATENT DOCUMENTS

| | | | |
|---|---|---|---|
| EP | 0 116 466 | A2 | 8/1984 |
| EP | 0419876 | A | 4/1991 |
| EP | 0857575 | A | 8/1998 |
| EP | 1122073 | A | 8/2001 |
| EP | 1164025 | A | 12/2001 |
| JP | 52-091319 | | 12/1975 |
| JP | 53-085867 | | 7/1978 |
| JP | 60-159931 | | 10/1985 |
| JP | 60-171834 | | 11/1985 |
| JP | 62-184856 | | 8/1987 |
| JP | 03-045843 | | 4/1991 |
| JP | 03-045843 | A | 4/1991 |
| JP | 03-227650 | A | 10/1991 |
| JP | 05-004349 | A | 1/1993 |
| JP | 05-016377 | | 1/1993 |
| JP | 05-162334 | | 6/1993 |
| JP | 05-462333 | | 6/1993 |
| JP | 06-008463 | | 1/1994 |
| JP | 06-015835 | A | 1/1994 |
| JP | 07-312211 | | 11/1995 |
| JP | 08-080618 | | 3/1996 |
| JP | 08-230950 | | 10/1996 |
| JP | 10-217499 | A | 8/1998 |
| JP | 10-308084 | | 11/1998 |
| JP | 11-070665 | | 3/1999 |
| JP | 11-129491 | | 5/1999 |
| JP | 11-157093 | | 6/1999 |
| JP | 11-157097 | | 6/1999 |
| JP | 11-176402 | | 7/1999 |
| JP | 2000-006431 | | 1/2000 |
| JP | 2000-158663 | | 6/2000 |
| JP | 2000-238278 | | 9/2000 |
| JP | 2000-296626 | A | 10/2000 |
| JP | 2000-334977 | | 12/2000 |
| JP | 2001-205819 | | 7/2001 |
| JP | 2001-287379 | A | 10/2001 |
| JP | 2001-341323 | A | 12/2001 |
| JP | 2001-353882 | | 12/2001 |
| JP | 2002-001979 | | 1/2002 |
| JP | 2002-019135 | A | 1/2002 |
| JP | 2002-362643 | | 12/2002 |
| JP | 2003-034038 | | 2/2003 |
| JP | 2003-053984 | | 2/2003 |
| JP | 2003-053984 | A | 2/2003 |
| JP | 2003-063573 | | 3/2003 |
| JP | 2003-103796 | A | 4/2003 |
| JP | 2003-266724 | | 9/2003 |
| JP | 2004-074801 | | 3/2004 |
| JP | 2004-090623 | | 3/2004 |

* cited by examiner

LIQUID CONTAINER

CROSS-REFERENCE TO RELATED APPLICATIONS

This application is a continuation of application Ser. No. 10/892,765, filed on Jul. 16, 2004, and which will issue as U.S. Pat. No. 7,367,662 on May 6, 2008.

This application relates to and claims priority from Japanese Patent Applications No. 2003-199035, filed on Jul. 18, 2003 and No. 2004-031294, filed on Feb. 6, 2004, the entire disclosure of which is incorporated by reference.

BACKGROUND

Technical Field

The present invention relates to a liquid container.

In a liquid ejection device, a liquid led out from the liquid container containing the liquid therein is ejected from a liquid ejection head and discharged onto a target facing the liquid ejection head. An ink-jet recording device is an example of such a liquid ejection device. In an ink-jet recording device, a recording head serving as a liquid ejection head is installed on a reciprocally moving carriage, and an ink is supplied from an ink cartridge as a liquid container into the recording head. Printing is then carried out by discharging the ink as a liquid, for example, on a paper as a target.

Among such ink-jet recording devices, there are devices with a configuration (the so-called off-carriage configuration) in which an ink cartridge is not installed on the carriage with the object of reducing a load applied to the carriage or reducing the dimensions and thickness of the device (see, for example, Patent Reference 1). The ink cartridge is so provided that it can be attached to the ink-jet recording device and detached therefrom, and ink is supplied to the recording head via a supply channel.

Patent Reference 1: JP-A-2002-1979

However, after the attached ink cartridge has been removed from the ink-jet recording device, the ink remains in the supply channel between the ink cartridge and the recording head. Therefore, the ink remaining in the supply channel can leak out of the opening of the channel.

It is an object of the present invention to provide a liquid container capable of opening and closing a liquid channel in a liquid ejection device according to the attachment and detachment of the liquid container.

SUMMARY OF THE INVENTION

The liquid container in accordance with the present invention is a liquid container which contains a liquid therein and is detachably mountable to a liquid ejection device, wherein an abutment surface for opening a channel valve by abutting against part of the channel valve provided in the liquid ejection device is provided in a connection surface having formed therein a liquid lead-out port for supplying the liquid to the outside.

Therefore, in the liquid container which is detachably mountable to a liquid ejection device, a liquid lead-out port is provided in the connection surface. Further, an abutment surface which abuts against part of the channel valve provided in the liquid ejection device is provided in the connection surface. The abutment surface opens the channel valve by abutting against part of the channel valve. As a result, the channel where the channel valve is provided can be opened by mounting the liquid container to the liquid ejection device.

In such a liquid container, a plurality of liquid lead-out ports are formed in the liquid container, and the abutment surface is provided between one of those liquid lead-out ports and adjacent one of the liquid lead-out ports.

Therefore, the abutment surface is provided between one of those liquid lead-out ports and adjacent one of the liquid lead-out ports. In other words, the abutment surface is provided between the liquid lead-out portions which are to be connected to the liquid ejection device. Therefore, when the liquid container is attached to the liquid ejection device, the position of the abutment surface can be comparatively accurately determined. As a result, the displacement in relative positions between the abutment surface and part of the channel valve is prevented, and the reliability of abutment operation of the abutment surface and part of the channel valve can be increased.

In the liquid container, the liquid lead-out port is so formed that a communicating portion formed in the liquid ejection device can be inserted therein, and the abutment surface lies in a plane perpendicular to the insertion direction of the communicating portion into the liquid lead-out port.

Therefore, the abutment surface is made up of a surface perpendicular to the insertion direction of the communicating portion into the liquid lead-out port. As a result, part of the channel valve can be reliably abutted against the abutment surface.

The liquid container in accordance with the present invention is a liquid container which contains a liquid therein and is detachably mountable to a liquid ejection device, and which includes: a liquid lead-out port into which a communicating portion provided at the side of the liquid ejection device can be inserted and which port is disposed in a connection surface; a liquid lead-in port that can receive a lead-in communicating portion provided in the liquid ejection device and that is disposed in one end side of the connection surface from a position where the liquid lead-out port is formed; and an abutment surface for opening a channel valve by abutting against part of the channel valve provided in the liquid ejection device, which abutment surface is disposed in an opposite end portion of the connection surface so that the liquid lead-out port is disposed between the abutment surface and the liquid lead-in port.

Therefore, in the liquid container that can be detachably mountable to a liquid ejection device, a liquid lead-out port is provided in the connection surface. Furthermore, in the liquid container, a liquid lead-in port is provided in one end portion from the liquid lead-out port in the connection surface. Furthermore, an abutment surface for abutting against part of the channel valve provided in the liquid ejection device is provided in an opposite end portion of the connection surface. This abutment surface opens the channel valve by abutting against part of the channel valve. As a result, the channel can be opened by attaching the liquid container to the liquid ejection device. Furthermore, when the liquid container is inserted into the liquid ejection device, the communicating portion and lead-in communicating portion are inserted into the liquid lead-out port and liquid lead-in port, respectively, and part of the channel valve is abutted against the abutment surface provided at the side opposite thereto. As a result, when the liquid container is inserted, it is supported at the liquid lead-out port, liquid lead-in port, and abutment surface. Therefore, the generation of a force acting in the direction of tilting the liquid container can be prevented. As a result, the generation of an unnecessary force in the communicating portion and liquid lead-out port can be prevented. In other words, forces acting in the portion for connection to the liquid container in the direction different from the insertion direction are reduced and the liquid container can be connected with good balance. Furthermore, the connection of the liquid lead-out port and liquid lead-in port with the communicating portion and lead-in communicating portion and the opening of the channel valve can be carried out by one operation by uni-directionally inserting the liquid container.

In the liquid container, a plurality of liquid lead-out ports are provided in a row and disposed in the connection surface, and the liquid lead-in port and the abutment surface are disposed on respective sides of the row of the liquid lead-out ports.

Therefore, the liquid lead-in port and the abutment surface are disposed on respective sides of the liquid lead-out ports. As a result, when the liquid container is inserted, the liquid lead-in port receives the lead-in communicating portion, and the abutment surface provided at the opposite side therefrom is abutted against part of the channel valve. As a consequence, when the liquid container is inserted, the liquid container is supported at least on both sides thereof. Therefore, the generation of a force acting in the direction of tilting the liquid container can be prevented. Furthermore, the application of an unnecessary force to the lead-in communicating portion can be prevented.

In the liquid container, a plurality of liquid lead-out ports are provided in a row and disposed in the connection surface, the liquid lead-in port is disposed at the outer side from the liquid lead-out ports provided in a row, and the abutment surface is disposed in the vicinity of a liquid lead-out port positioned opposite the liquid lead-in port.

Therefore, the liquid lead-in port is disposed at the outer side from the liquid lead-out ports. Further, the abutment surface is disposed in the vicinity of a liquid lead-out port positioned opposite the liquid lead-in port. As a result, when the liquid container is inserted, the liquid lead-in port is inserted onto the lead-in communicating portion and part of the channel valve is abutted against the abutment surface provided at the side opposite thereto. As a result, when the liquid container is inserted, it can be supported at least outside the liquid lead-out ports and in the vicinity of the liquid lead-out port. Therefore, the generation of a force acting in the direction of tilting the liquid container can be prevented more reliably. Furthermore, the application of an unnecessary force to the lead-in communicating portion can be prevented.

In the liquid container, the abutment surface and the liquid lead-in port are formed in positions having the same height when the liquid container is attached to the liquid ejection device.

Therefore, the abutment surface and liquid lead-in port are formed in positions having the same height when the liquid container is attached to the liquid ejection device. As a consequence, the generation of a force acting in the direction of tilting the liquid container can be prevented more reliably. Furthermore, the application of an unnecessary force to the lead-in communicating portion can be prevented.

In the liquid container, the front surface of the liquid lead-out port or liquid lead-in port protrudes from the abutment surface.

Therefore, because the front surface of the liquid lead-out port or liquid lead-in port protrudes from the abutment surface, when the liquid container is attached to the liquid ejection device, the liquid lead-out port or liquid lead-in port is inserted into the liquid ejection device prior to the abutment surface. In other words, the liquid lead-out port or liquid lead-in port is the first to be inserted into the liquid ejection device, thereby aligning the liquid container or forming a support point at the connection surface. As a result, the posture of the liquid container is stabilized. Therefore, the abutment surface can be abutted against part of the channel valve after the liquid container has been stabilized.

In the liquid container, in the connection surface of the liquid container, there are formed aligning holes which are to be engaged with respective aligning convex portions provided in the liquid ejection device, and one of the aligning holes is formed in the vicinity of the abutment surface.

Therefore, aligning holes which are to be engaged with respective aligning convex portions provided in the liquid ejection device are formed in the connection surface of the liquid container. Furthermore, one of the aligning holes is formed in the vicinity of the abutment surface. In other words, when the liquid container is attached, the alignment of the liquid container is carried out by engaging the aligning convex portion with aligning holes. Therefore, the alignment can be carried out with good accuracy.

In the liquid container, a circuit substrate having a memory that stores information relating to the liquid container is provided in the vicinity of the abutment surface, and a contact for connecting to a terminal provided in the liquid ejection device when the liquid container is attached to the liquid ejection device is disposed in the circuit substrate.

Therefore, a circuit substrate having a memory that stores information relating to the liquid container is provided in the vicinity of the abutment surface of the liquid container, and this circuit substrate is connected to the terminal provided in the liquid ejection device. As a result, information relating to the liquid container can be transmitted to the liquid ejection device.

In the liquid container, a substrate accommodation portion for accommodating the circuit substrate is formed in the surface intersecting the connection surface, the substrate accommodation portion is open at the connection surface and at the surface intersecting the connection surface, and the contact of the circuit substrate disposed in the circuit accommodation portion is provided proximate the surface intersecting the connection surface.

Therefore, a substrate accommodation portion is formed in the liquid container and this substrate accommodation portion is open at the connection surface and at the surface intersecting the connection surface. Moreover, in the circuit substrate disposed in the circuit accommodation portion, the contact is disposed proximate the surface intersecting the connection surface. Therefore, the terminal for connecting to the contact can be inserted through each opening and the terminal can be connected to the contact of the circuit substrate. Therefore, the circuit substrate can be easily connected to the terminal of the liquid ejection device.

In the liquid container, the circuit substrate is positioned below the abutment surface of the liquid container when the liquid container is attached to the liquid ejection device.

Therefore, the circuit substrate is disposed below the abutment surface of the liquid container when the liquid container is attached to the liquid ejection device.

The present disclosure relates to the subject matter contained in Japanese patent application No. 2003-199035 (filed on Jul. 18, 2003) and 2004-031294 (filed on Feb. 6, 2004), each of which is expressly incorporated herein by reference in its entirety.

DESCRIPTION OF THE PREFERRED EMBODIMENT

First Embodiment

The first embodiment in which the present invention was realized will be described hereinbelow with reference to FIGS. 1 to 12.

Figure 1:
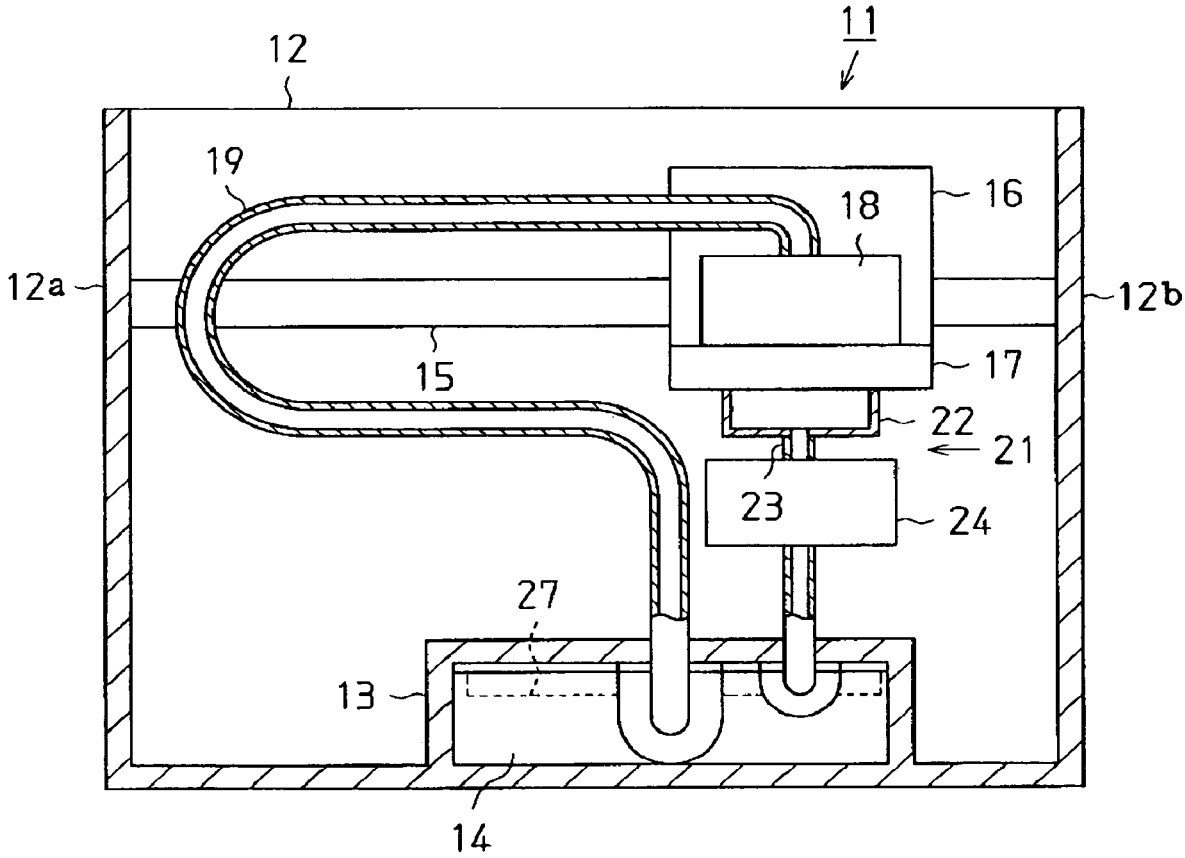
FIG. 1 is a schematic drawing of the printer of the first embodiment.

FIG. 1 is a schematic drawing of an ink-jet recording device (referred to hereinbelow as "printer") which serves as a liquid ejection device. The printer comprises a printer body 11 inside an external case (not shown in the figure). The printer body 11 comprises a frame 12. A cartridge accommodation portion 13 is provided inside the frame 12. An ink cartridge 14 serving as a liquid container which contains ink as a liquid inside thereof is detachably provided in the cartridge accommodation portion 13. The ink cartridge 14 supplies ink via supply channels 19 to sub-tanks 18 placed on a carriage 16. The printer is provided with one ink cartridge 14, and the sub-tanks 18 and supply channels 19 whose number is equal to that of the types of inks used in the printer are provided with regards to this ink cartridge 14. In the present embodiment, a total of six supply channels 19 and six sub-tanks 18 are provided, but FIG. 1, for the sake of convenience, shows only one supply channel 19 and one sub-tank 18.

The carriage 16 is slidably supported on a guide member 15 hanging between a left plate 12*a* and right plate 12*b* of the frame 12. The sub-tank 18 placed on the carriage 16 temporarily retains inside thereof the ink which is supplied from the ink cartridge 4 in order to stabilize the supply of the ink to the recording head 17.

The recording head 17 is placed on the lower surface of the carriage 16. The recording head 17 comprises a plurality of nozzles (not shown in the figure), and the nozzles are open at the lower surface of the recording head 17. The recording head 17 discharges ink drops serving as a liquid from the nozzle openings toward the paper serving as a target (not shown in the figure).

Furthermore, a home position in which the carriage 16 is disposed when the printer body 11 is in a non-printing state is provided in the frame 12. A head maintenance mechanism 21 for preventing the nozzles of the printing head 17 from clogging is installed in this home position. The head maintenance mechanism 21 comprises a cap 22 and a tube pump 24. The cap 22 and the tube pump 24 are connected to each other by a tube 23.

In order to prevent the increase in the ink viscosity inside the nozzle when the printer body 11 is in a non-printing state, the head maintenance mechanism 21 seals the lower surface of the printing head 17 with the cap 22. Furthermore, in order to prevent the nozzles from clogging, suction cleaning is conducted by forcibly sucking the ink from the nozzles. In such suction cleaning, a negative pressure is generated inside the cap 22 by driving the tube pump 24 after the lower surface of the printing head 17 has been sealed with the cap 22. Under the effect of the generated negative pressure, the ink located inside the nozzle is discharged into the cap 22.

The ink that was discharged into the cap 22 by the suction cleaning passes through inside the cap 23 and is accumulated in a waste ink accommodation portion 27 provided in the ink cartridge 14. The waste ink accommodation portion 27 is provided inside the ink cartridge 14.

(Ink Cartridge)

Figure 2:
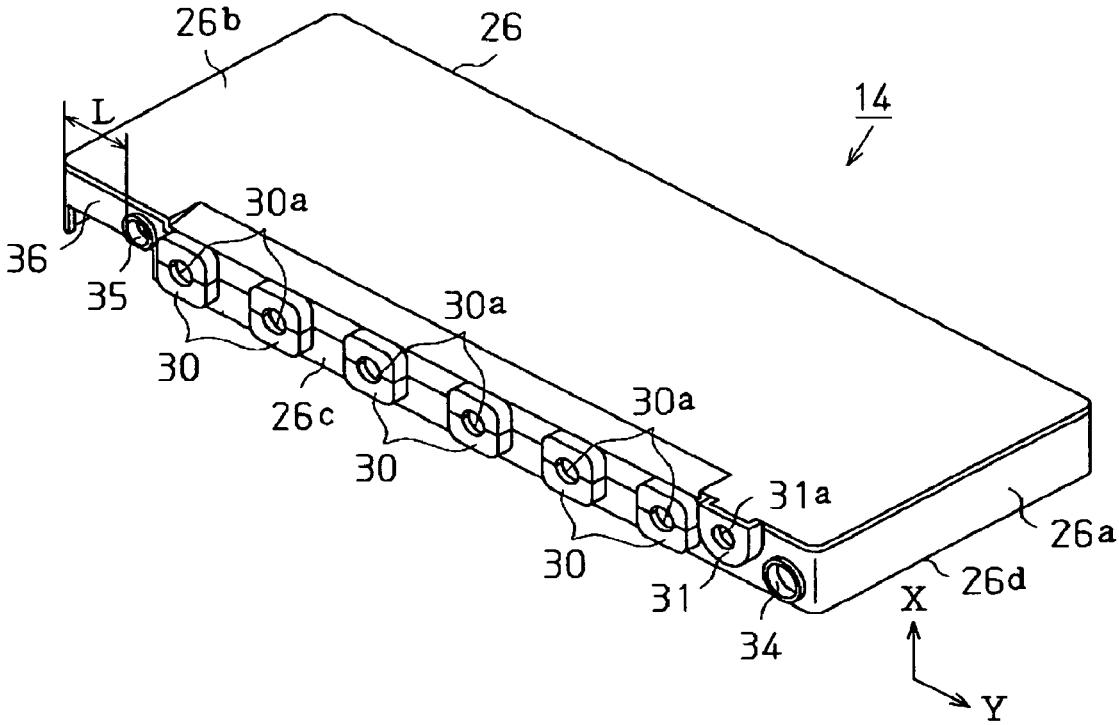
FIG. 2 is a perspective view of the ink cartridge provided in the printer of the first embodiment.
Figure 3:
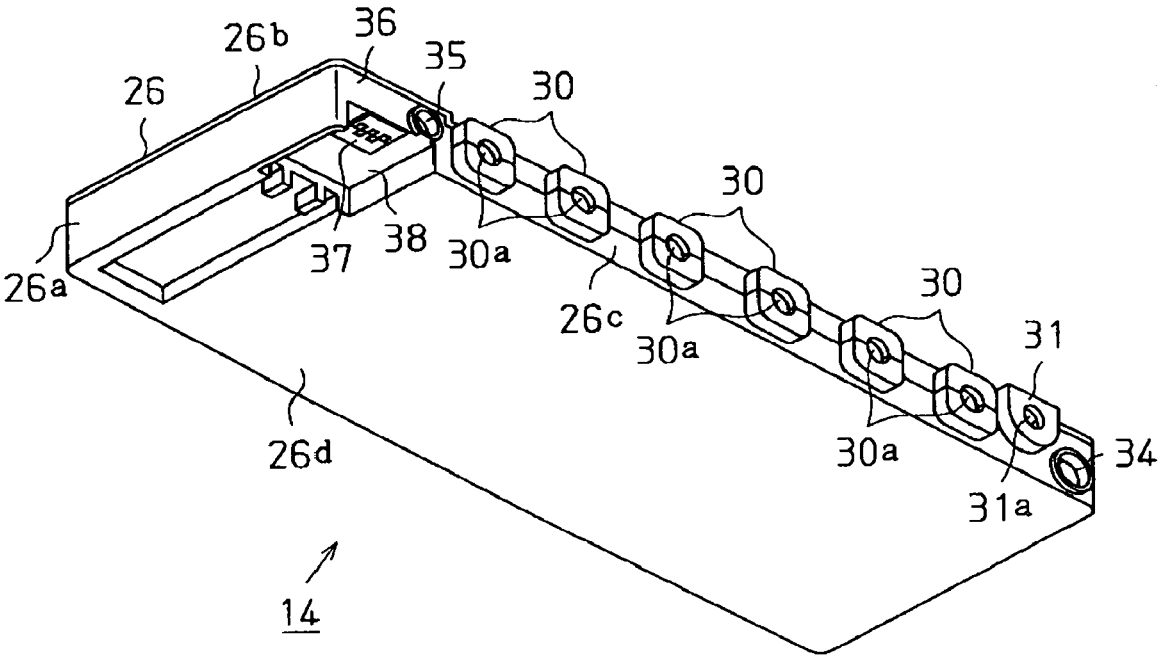
FIG. 3 a perspective view of the ink cartridge of the first embodiment.
Figure 4:
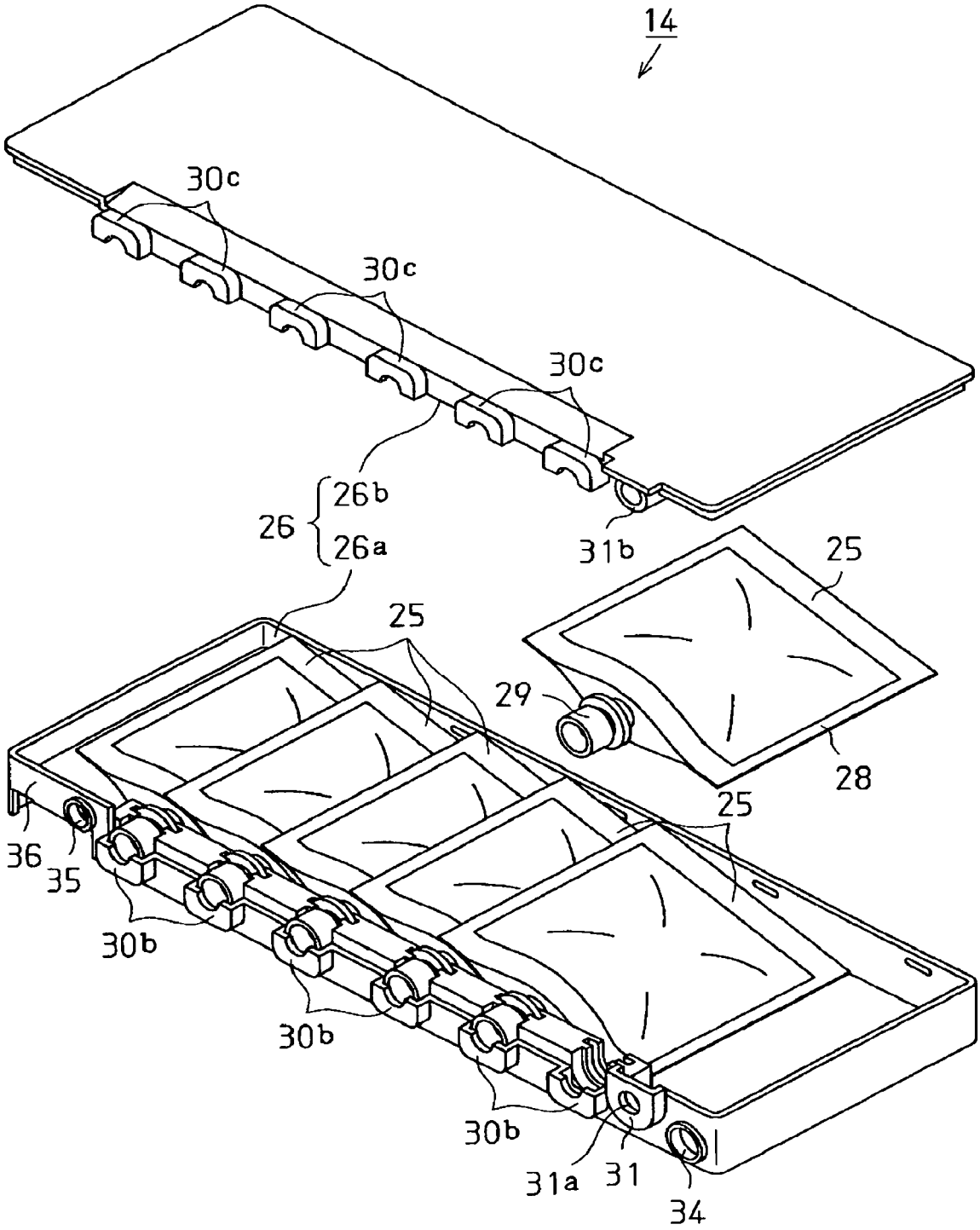
FIG. 4 is an exploded perspective view of the ink cartridge of the first embodiment.
Figure 5:
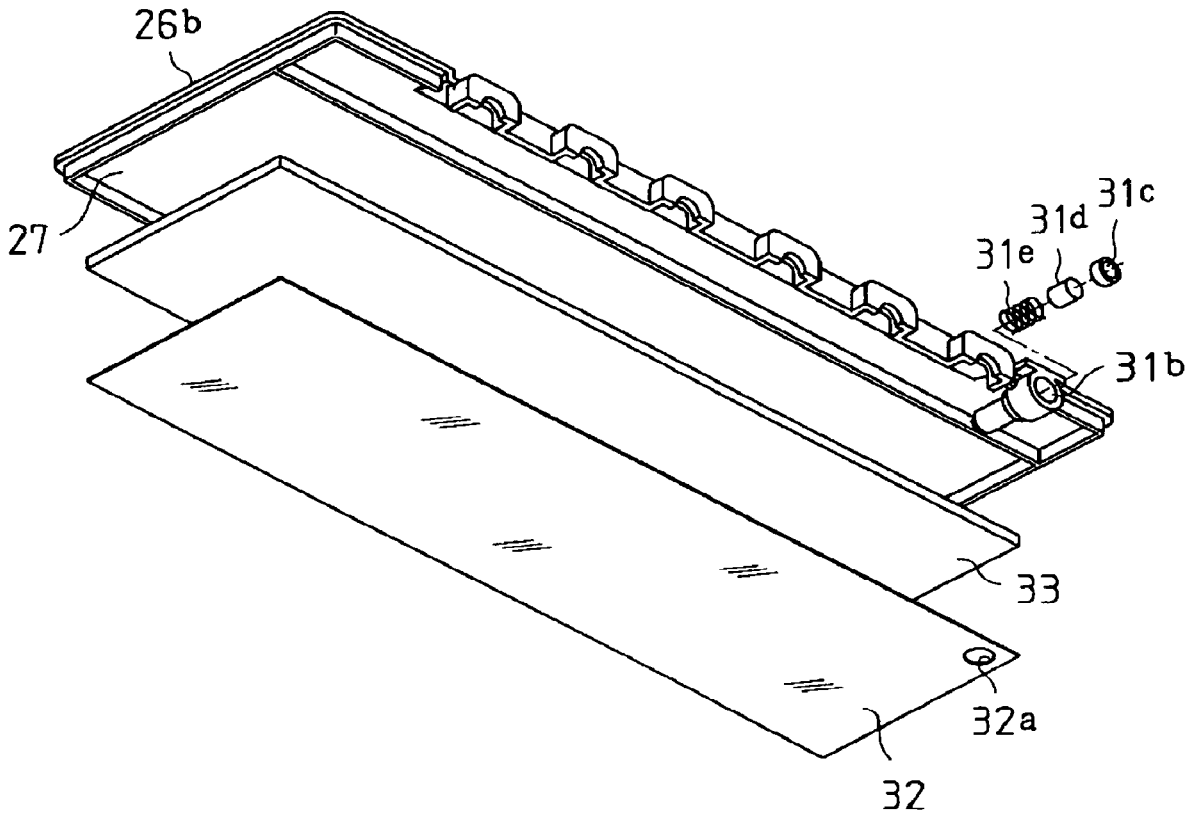
FIG. 5 is an exploded perspective view of the lid portion of the ink cartridge of the first embodiment.

The ink cartridge 14 will be described hereinbelow in greater detail. FIG. 2 and FIG. 3 are the perspective views of the ink cartridge 14. FIG. 4 is an exploded perspective view of the ink cartridge 14. FIG. 5 is an exploded perspective view of the lid 26*b* of the ink cartridge 14.

As shown in FIG. 4, the ink cartridge 14 is constructed by a plurality of ink packs 25 which are liquid containing packs and an accommodation case 26 for accommodating those packs. An ink pack 25 is made up of a pack portion 28 and an ink lead-out member 29. The pack portion 28 is produced by thermally fusing four sides of two laminate films, each obtained by depositing aluminum on a polyethylene film having gas barrier properties. Thus, in the pack portion 28, three sides of two stacked laminate films are fused, and the remaining one side is thermally fused in a state such that the ink lead-out member 29 is disposed so as to protrude from the center thereof, thereby forming a pack. The inside of the pack portion 28 is filled with the ink which is led out from the ink lead-out member 29.

The accommodation case 26 is made up of an almost box-like case body 26*a* having an opening in the upper part thereof and an almost plate-like lid portion 26*b* for covering the opening in the case body 26*a*. As shown in FIG. 2 and FIG. 3, a total of six support portions 30 whose number is equal to the number of ink packs 25 which are to be accommodated are provided at the front surface 26*c* which serves as a connection surface of the accommodation case 26. Each support portion 30 constituting a liquid lead-out port is formed so as to protrude from the front surface 26*c* of the accommodation case 26. Those support portions 30 are provided to support the ink lead-out members 29 of the above-descried ink packs 25, respectively, and are provided almost in the center of the front surface 26*c* of the accommodation case 26. Furthermore, the support portion 30 has a lead-out side insertion hole 30*a* constituting the liquid lead-out port.

Further, as shown in FIG. 4, in those support portions 30, a lower support portion 30*b* constituting the lower half thereof is provided at the case body 26*a*, and an upper support portion 30*c* constituting the upper half thereof is provided at the lid portion 26*b*. During assembling, the lid portion 26*b* is attached after the ink lead-out member 29 of the ink pack 25 has been supported on the lower support portion 30*b* of the case body 26*a*. Further, the ink lead-out member 29 is fixed by engaging the lower support portion 30*b* and upper support portion 30*c*.

As shown in FIG. 2, one lead-in support portion 31 constituting a liquid lead-in port is formed in the vicinity of the support portion 30 formed at the outermost end, which is the front surface 26*c* of the case body 26*a*. This lead-in support portion 31 is so formed as to protrude from the front surface 26 in the position closer to the upper surface side of the accommodation case 26 than the support portion 30. In the present embodiment, the lead-in support portion 31 is the right side of the support portion 30 formed at the rightmost side and is provided in a protruding condition close to the lid portion 26*b*. The lead-in insertion hole 31*a* constituting the liquid lead-in port is formed in the lead-in support portion 31 so as to pass completely through to the other side. The lead-in insertion hole 31*a* is in communication with the waste ink accommodation portion 27 provided in the lid portion 26*b*.

As shown in FIG. 5, the waste ink accommodation portion 27 is provided in the lid portion 26*b*. Thus, the waste ink accommodation portion 27 is provided between the lid portion 26*b* and a sealing film 32 by fixing four sides of the sealing film 32 by thermal fusion to the lid portion 26*b*. A hole 32*a* is formed in the corner of the sealing film 32, and the waste ink accommodation portion 27 is in communication with the atmosphere via the hole 32*a*. When the sealing film 32 is thermally fused, a waste ink absorption material 33 made up of a porous member and capable of absorbing the ink is disposed between the sealing film 32 and the lid portion 26*b* and the edge portion of the sealing film 32 is thermally fused. Furthermore, a wall-side communicating portion 31*b* having a channel in communication with the waste ink accommodation portion 27 is formed in the wall portion 26*b*, and when the lid portion 26*b* is engaged with the case body 26*a*, the wall-side communicating portion 31*b* is engaged with the lead-in support portion 31. Therefore, the waste ink which is led in from the lead-in support portion 31 is introduced into the waste ink accommodation portion 27 via the lead-in insertion hole 31*a* and wall-side communicating portion 31*b* and absorbed by the waste ink absorption material 33.

Further, a valve is provided inside the wall-side communicating portion 31*b*. This valve is made up of a sealing rubber 31*c*, a valve body 31*d*, and a compression spring 31*e*. When no pushing force is applied from the outside to the valve body 31*d*, the compression spring 31*e* biases the valve body 31*d* to the sealing rubber 31*c*, thereby fitting the valve body 31*d* with the sealing rubber and closing the wall-side communicating portion 31*b*. If the valve body 31*d* is pushed toward the wall portion 26*b*, the valve body 31*d* moves toward the wall portion 26*b* and separates itself from the sealing rubber 31*c*. The waste ink can flow into the wall-side communicating portion 31*b* from the gap between the sealing rubber 31*c* and valve body 31*d*.

Furthermore, as shown in FIG. 2, a first fitting hole 34 serving as an aligning hole is formed at a position closer to the end from the lead-in support portion 31 in the front surface 26*c* of the accommodation case 26. In the present invention it is formed to the right from the lead-in support portion 31. Furthermore, a second fitting hole 35 serving as an aligning hole is formed in the end portion on the opposite side from the side where the first fitting hole 34 is formed, in the front surface 26*c* of the accommodation case 26. In the present embodiment, the second fitting hole 35 is formed in a position separated by length L as the prescribed spacing from one end of the accommodation case 26.

As shown in FIG. 3, a substrate accommodation portion 38 for accommodating a circuit substrate 37 is formed in the lower surface 26*d* of the case body 26*a*, which is below the second fitting hole 35. The substrate accommodation portion 38 is provided in the form of a recess in the lower surface 26*d* of the case body 26*a* and is open at the lower surface 26*d* and front surface 26*c* of the case body 26*a*. The circuit substrate 37 is provided in the upper surface of the substrate accommodation portion 38.

The circuit substrate 37 comprises an electrode contact and a semiconductor storage device serving as storage means capable of reading and writing data (not shown in the figures). The storage device stores data relating to the ink type, residual amount of ink, serial number, or effective life.

As shown in FIG. 2 and FIG. 3, an abutment surface 36 is provided at the end side from the second fitting hole 35 of the front surface 26*c* of the accommodation case 26. Thus, the surface having a length L from the second fitting hole 35 to the end of the accommodation case 26 serves as the abutment surface 36. This abutment surface 36 is a surface perpendicular to the insertion direction of the ink cartridge 14 (direction along which the communicating portion 43 is inserted into the lead-in member 29) and is formed to be smooth. It is also so formed that when the ink cartridge 14 is installed in the cartridge accommodation portion 13, the height thereof becomes equal to that of the lead-in support portion 31. Therefore, the height of the center of the lead-in insertion hole 31*a* is almost equal to the height of the center of the abutment surface 36 in the X direction in FIG. 2.

(Connection Portion 41 and a Channel Valve 42 Provided in the Connection Portion 41)

Figure 6:
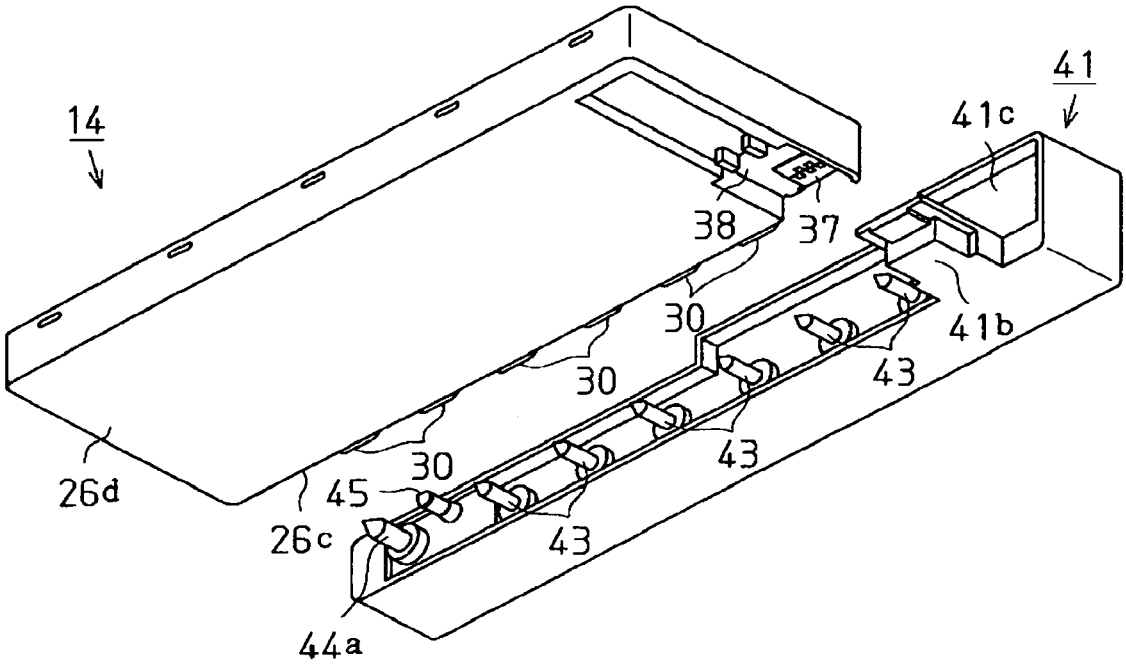
FIG. 6 is a perspective view of the connection portion prior to the connection of the ink cartridge of the first embodiment.
Figure 7:
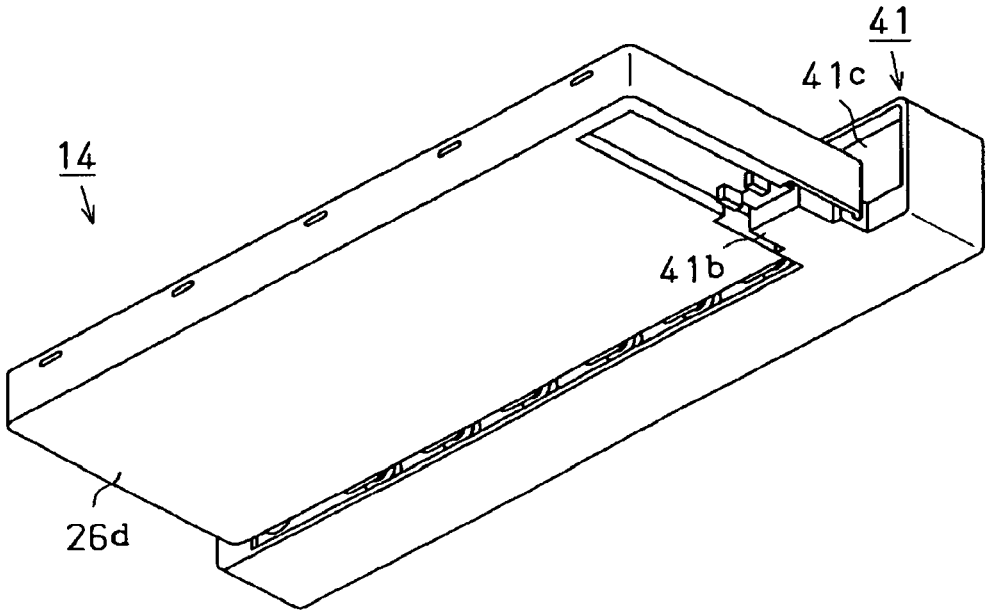
FIG. 7 is a perspective view illustrating the state in which the ink cartridge of the first embodiment is attached to the connection portion.
Figure 8:
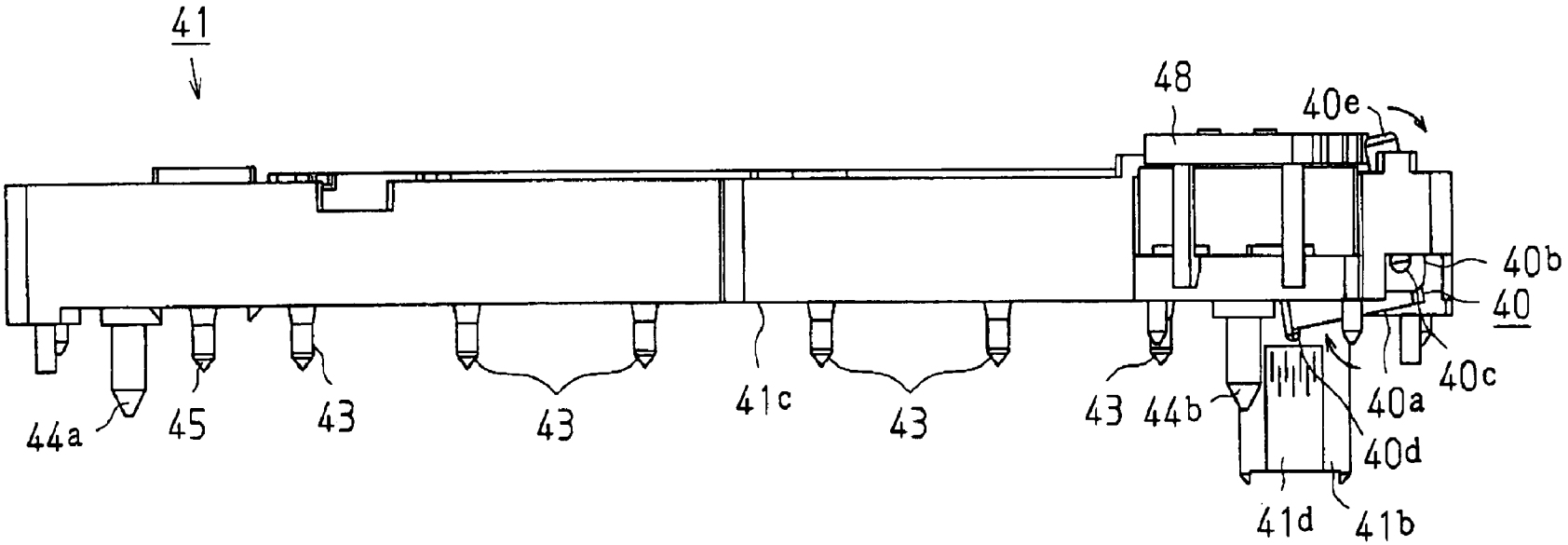
FIG. 8 is a plan view of the connection portion.
Figure 9:
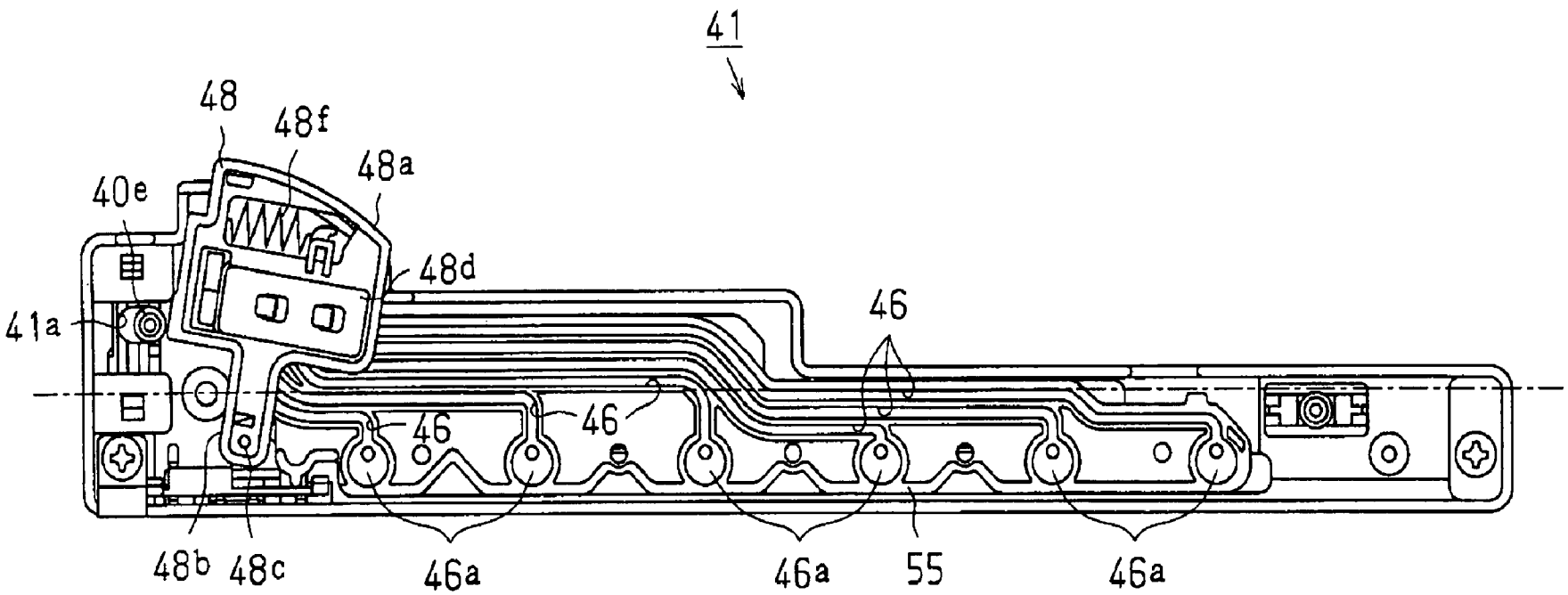
FIG. 9 is a rear view of the connection portion.
Figure 10:
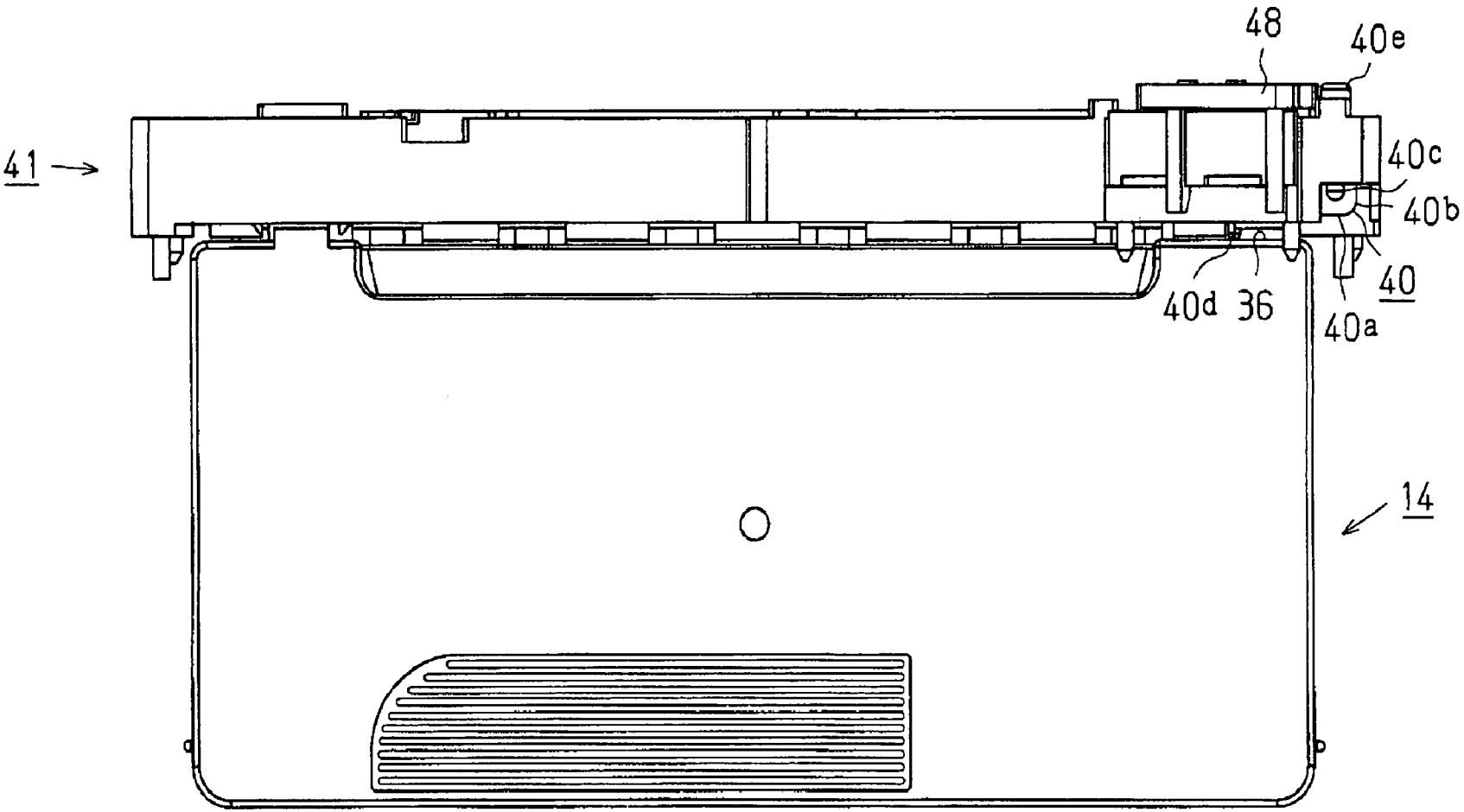
FIG. 10 is a plan view of the connection portion to which the ink cartridge has been attached.
Figure 11:
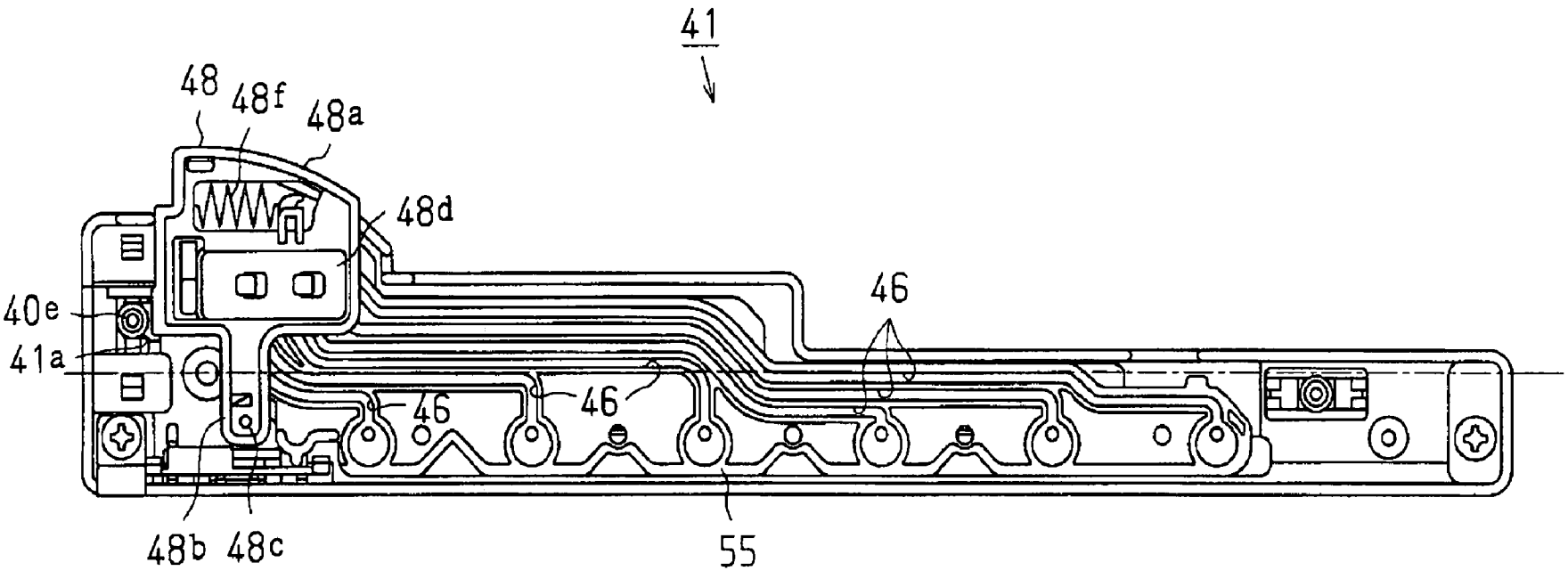
FIG. 11 is a rear view of the connection portion.
Figure 12:
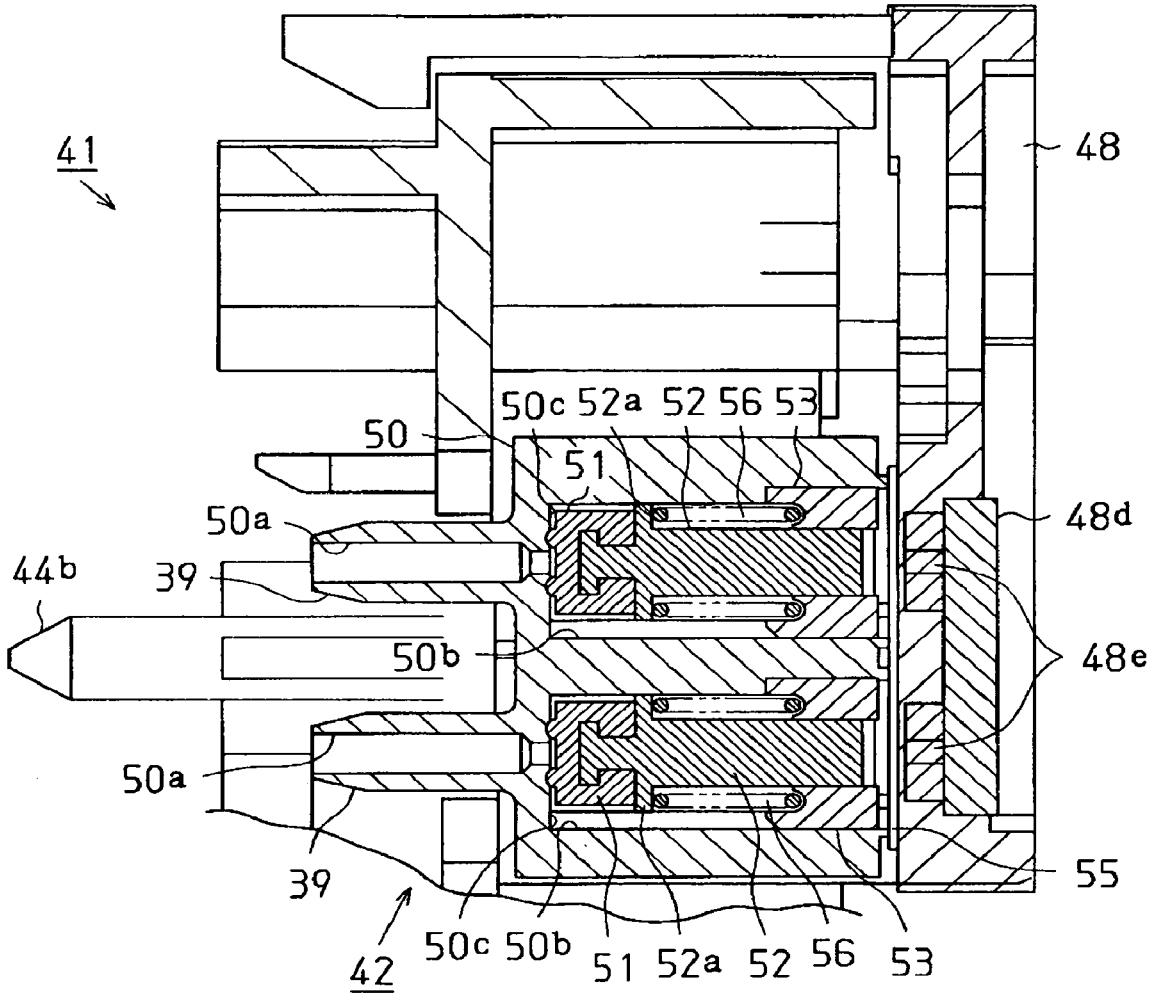
FIG. 12 is a cross-sectional view of the main part of the channel valve provided inside the connection portion.

The connection portion 41 which is connected to the ink cartridge 14 will be described below. This connection portion 41 is provided in the cartridge accommodation portion 13 and fixes the front surface 26 of the ink cartridge 14 when the ink cartridge 14 is disposed in the cartridge accommodation portion 13. FIG. 6 is a perspective view of the connection portion 41 prior to attaching the ink cartridge 14. FIG. 7 is a perspective view of the connection portion 41 with the attached ink cartridge 14. Furthermore, FIG. 8 is a plan view of the connection portion 41 to which the ink cartridge 14 has not been attached. FIG. 9 is a rear surface view thereof. FIG. 10 is a plan view of the connection portion 41 to which the ink cartridge 14 has been attached. FIG. 11 is a rear surface view thereof. Further, FIG. 12 is a cross-sectional view of the channel valve 42 provided inside the connection portion 41.

As shown in FIG. 6, the connection portion 41 is formed to have an almost rectangular parallelepiped shape and is provided in the cartridge accommodation portion 13 so that the connection surface 41*c* thereof and the front surface 26*c* of the accommodation case 26 face each other after the ink cartridge 14 has been inserted into the cartridge accommodation portion 13. Further, as shown in FIG. 7, it fixes the front surface 26*c* of the case body 26*a* of the ink cartridge 14 after the ink cartridge 14 has been installed in the cartridge accommodation portion 13. Only the essential part of the connection portion 41 is shown in FIG. 6 and FIG. 7, and individual members incorporated in the connection portion 41 are not shown in the figures.

A terminal arrangement portion 41*b* is provided at the right end of the connection portion 41 shown in FIG. 6 and FIG. 7. This terminal arrangement portion 41*b* is provided with a terminal mechanism 41*d* (see FIG. 8). Further, when the ink cartridge 14 is attached to the connection portion 41, the terminal arrangement portion 41*b* is slidingly inserted from the opening of the substrate accommodation portion 38 of the case body 26*a* and the terminal mechanism 41*d* is electrically connected to the circuit substrate 37.

As shown in FIG. 6 and FIG. 8, in the connection portion 41, a total of six communicating portions 43 whose number is equal to that of the support portions 30 of the ink cartridge 14 are provided in a protruding condition at the connection surface 41*c* fixing the front surface 26*c* of the accommodation case 26. The communicating portions 43 are provided in positions facing the positions of the support portions 30 when the ink cartridge 14 is fixed to the connection portion 41, and the distal ends thereof are formed to have a needle-like shape so that they can be inserted into the ink lead-out members 29 via the lead-out insertion holes 30*a* of the support portions 30. The distal end surface of the communicating portion 43 has the lead-out through holes (not shown in the figures) for leading the ink from the ink cartridge 14 to the outside.

Further, as shown in FIG. 8, a first protrusion 44*a* and a second protrusion 44*b* which can be fitted to the first fitting hole 34 and second fitting hole 35, respectively, are formed at the outer sides of the communicating portions 43, in the connection surface 41*c* of the connection portion 41. The alignment of the ink cartridge 14 is conducted by fitting the first protrusion 44*a* and second protrusion 44*b* serving as aligning convex portions to the first fitting hole 34 and second fitting hole 35, respectively. Further, a lead-in communicating portion 45 for insertion into the lead-in support portion 31 is provided in a protruding condition between the communicating portion 43 and the first protrusion 44*a* for fitting with the first fitting hole 34. The lead-in communicating portion 45 is provided in a position facing the lead-in support portion 31 and the distal end thereof is formed to have a needle-like shape.

As shown in FIG. 9, ink channels 46 are formed in the surface on the opposite side from the connection surface 41*c* of the connection portion 41. The ink that was led out from the ink cartridge 14 via the communicating portion 43 flows in through the corresponding ink channel 46. A total of six ink channels 46 are formed, this number corresponding to the number of ink types. One surface of each ink channel 46 is open, and this open surface is sealed with a film material 55 having gas barrier property which is attached by thermal fusion to the side surface on the opposite side from the connection surface 41*c*.

Circular concave portions 46*a* are provided in the starting ends of the ink channels 46. One end of a lead-out hole so formed in each communicating portion 43 as to pass therethrough to the is open at the bottom surface of the circular concave portion 46*a*. The ink channels 46 which are provided in extending condition from the circular concave portions 46*a* extend along the longitudinal direction of the connection portion 41 and are collected in the end part of the connection portion 41. Further, the ink channels 46 bend toward the connection surface 41*c* in the end portion thereof and are open at the upper end surfaces of respective lead-out portion 39 (see FIG. 12) formed at the connection surface 41*c* side. Therefore, the ink flowing in from each communicating portion 43 is led to the outside from each corresponding lead-out portion 39 via each ink channel 46. A total of six lead-out portions 39 are formed, this number corresponding to that of the ink channels 46. Each lead-out portion 39 is in communication with a corresponding sub-tank 18 via a corresponding supply channel 19.

The ink channel 46 has a channel valve 42, which is provided, as shown in FIG. 12, inside the channel from the position where the channel bends toward the connection surface 41*c* to the position of the lead-out portion 39. One channel valve 42 is provided in each ink channel 46.

As shown in FIG. 12, the channel valve 42 comprises a channel-forming member 50, a sealing portion 51, a movable member 52, and a support member 53. The channel-forming portion 50 is made of a resin such as polypropylene and polyethylene and is disposed inside the connection portion 41. A small-diameter hole 50*a* and a large-diameter hole 50*b* are formed in the channel-forming member 50. Those small-diameter hole 50*a* and large-diameter hole 50*b* constitute the ink channel 46 and lead-out portion 39. The small-diameter hole 50 is formed in the lead-out portion 39 so as to pass therethrough. A cylindrical support member 53 is press fitted to the large-diameter hole 50*b* along the wall surface, and the base end portion of the movable member 52 is inserted into this support member 53 so that it is free to move reciprocally inside thereof. The movable member 52 is a magnetic body formed to have a rod-like shape and comprises a flange 52*a* at the outer peripheral surface thereof.

A sealing portion 51 is joined at the distal end portion side from the flange 52*a*. The sealing portion 51 is made of an elastic material such as elastomers, CR rubber, silicone rubber, or NBR and has an annular protruding portion formed at one side surface thereof. This protruding portion is slightly tapered at the upper end edge thereof and is easily pressed in when brought into contact with other members under pressure. The sealing portion 51 is disposed so that the aforementioned protruding portion faces the small-diameter hole 50*a*. By the movement of the movable member 52 toward the small-diameter hole 50*a*, the sealing portion 51 abuts against the abutment surface 50*c* where the small-diameter hole 50*a* is open, and the sealing portion 51 closes the small-diameter hole 50*a* and closes the ink channel 46.

Further, a coil spring 56 for biasing the movable member 52 toward the small-diameter hole 50 is disposed between the flange 52*a* and the support member 53. As a result, the movable member 52 receives a biasing force toward the small-diameter hole 50*a*. In other words, an elastic force is given to the movable member 52 in the direction of closing the ink channel 46.

If a plurality of magnets 48*e* provided in a rotary member 48 described later are so disposed as to face the base end portions of corresponding movable members 52, then the movable members 52 are moved by the magnetic force toward the magnets 48*e* against the biasing force of the coil springs 56. If the movable members 52 move toward the magnets 48*e*, the sealing portions 51 and abutment surfaces 50*c* are separated, the ink flows in from the gap between the sealing portions 51 and abutment surfaces 50*c*, and the ink channels 46 are put into an open state. If the magnets 48*e* of the rotary member 48 are disposed in positions distanced from the base end portions of the movable members 52, respectively, the movable members 52 are moved toward the small-diameter holes 50*a* by the biasing force of the coil springs 56, and the ink channels 46 are put into a closed state. FIG. 12 shows the channel valves 42 in a closed state thereof.

As shown in FIG. 9, the rotary member 48 comprises a magnet retaining portion 48*a* in the form of an almost rectangular parallelepiped and an arm portion 48*b* extending from the magnet retaining portion 48*a*. A rotary shaft 48*c* serving as a rotation center is attached to the end portion of the arm portion 48*b*, and the rotary shaft 48*c* rotatably supports the rotary member 48. A total of six magnets 48*e* (see FIG. 12) are assembled in the magnet retaining portion 48*a* correspondingly to the aforementioned movable members 52, and a plate-like magnetic member 48*d* is disposed from above the magnets 48*e*. When the rotary member 48 is disposed in a position shown in FIG. 11, the magnets 48 are so disposed as to face the base end portions of the respective movable members 52 via the film member 55. The rotation of the rotary member 48 changes the position of each magnet 48*e* between a position distanced from the base end portion of the movable member 52 and a position opposite the base end portion, thereby causing reciprocal movement of the movable member 52.

Further, a biasing spring 48*f* is disposed in the magnet retaining portion 48*a* of the rotary member 48. One winding end of the biasing spring 48*f* is fixed to the rotary member 48 and the other winding end thereof is fixed to the side of the connection portion 41, and the spring 48*f* biases the rotary member 48 to the pressure release position shown in FIG. 11.

Further, a lever 40 for rotating the rotary member 48 is provided in the connection portion 41. The lever 40, as shown in FIG. 8, is provided closer to the end portion from the second protrusion 44*b*, of the connection portion 41. The lever 40 comprises an actuation piece 40*a*, a driven piece 40*b*, and a rotary shaft 40*c* serving as a rotation center for linking and fixing the actuation piece 40*a* and driven piece 40*b*. The lever 40 is biased by an biasing spring (not shown in the figure) to the rotation start position shown in FIG. 8. The lever 40 biased to the rotation start position is slightly inclined toward the end portion.

The actuation piece 40*a* is formed to have a plate-like shape, and a protrusion 40*d* is provided at the distal end thereof. The protrusion 40*d* is so formed as to protrude from a side of the actuation piece 40*a*, and the distal end thereof is formed to have a tapered shape. When the ink cartridge 14 is fixed to the connection portion 41, the protrusion 40*d* and the abutments surface 36 of the ink cartridge 14 are brought into contact with each other, thereby rotating the lever 40 clockwise (as shown by an arrow in the figure) as shown in FIG. 8, around the rotary shaft 40*c* as a rotation center.

The driven piece 40*b* is formed to have a rod-like shape and is formed to extend so that the longitudinal direction thereof is almost perpendicular to the longitudinal direction of the actuation piece 40*a*. As a result, the angle formed by the actuation piece 40*a* and driven piece 40*b* is almost 90°. The base end of the driven piece 40*b* is fixed by the rotary shaft 40*c*, and an end portion 40*e* at the distal end side passes through an elliptical hole 41*a* (see FIG. 9) formed in the connection portion 41. Further, the end portion 40*e* of the driven piece 40*b* is engaged with one side surface of the aforementioned rotary member 48.

When the ink cartridge 14 is not attached to the connection portion 41, the protrusion 40*d* does not receive a pushing force. Therefore, the lever 40 is biased by the aforementioned biasing spring to the rotation start position. At this time, the end portion 40*e* of the driven piece 40*b*, as shown in FIG. 9, is disposed at the side of the rotary member 48 against the elastic force of the biasing spring 48*e* provided at the rotary member 48. In the present embodiment, as shown in FIG. 9, the end portion 40*e* is disposed at the right end of the hole 41*a*. This position is considered as the operation position of the end portion 40*e*. The end portion 40*e* disposed in the operation position pushes the rotary member 48 toward the ink channel 46 by applying pressure to one side of the rotary member 48. The position of the rotary member 48 at this time is assumed to be a push position.

Each magnet 48*e* of the rotary member 48 disposed in the push position is disposed in a position distanced from the base end portion of the corresponding movable member 52. As a result, the movable members 52 of the channel valves 42 are moved by the biasing force of coil springs 56 toward the small-diameter holes 50*a* and the sealing portions 51 close the small-diameter holes 50*a*. Therefore, when the ink cartridge 14 is not attached, the ink channels 46 are closed. As a result, when the ink cartridge 14 is not attached, the ink located inside the ink channels 46 is prevented from leaking from the communicating portions 43.

When the ink cartridge 14 is attached to the connection portion 41, the ink cartridge 14 is aligned by fitting the first protrusion 44*a* and second protrusion 44*b* with respective first fitting hole 34 and second fitting hole 35 of the ink cartridge 14. Then, the communicating portions 43 are inserted and fitted into the support portions 30, and the lead-in communicating portion 45 is inserted into the lead-in support portion 31. At this time, the ink cartridge 14 is pushed to the connection surface 41*c* of the connection portion 41, and the lead-in support portion 31 and support portions 30 protruding from the front surface 26*c* of the accommodation case are introduced in the connection portion 41 side. As a result, the protrusion 40*d* is brought into contact with the abutment surface 36 of the ink cartridge 14, and the protrusion 40*d* is pushed toward the connection portion 41. If a pressure is applied to the protrusion 40*d*, the actuation piece 40*a* rotates clockwise, as shown in FIG. 8, around the rotary shaft 40*c* against the biasing force of the biasing spring, the driven piece 40*b* follows the rotation of the actuation piece 40*a* and rotates in the clockwise direction shown in the figure.

Further, as shown in FIG. 10, if the ink cartridge 14 is fixed to the connection portion 41, the lever 40 is positioned in the rotation end position. At this time, as shown in FIG. 11, the end portion 40*e* of the driven piece 40*b* moves in the hole 41*a* to the opposite side from the side of the rotary member 48. At this time, in the present embodiment, the end portion 40*e* is positioned in the left end of the hole 41*a*. For this reason, the rotary member 48 is rotated by the elastic force of the biasing spring 48*f* and disposed in the pressure release position.

Each magnet 48*e* of the rotary member 48 disposed in the pressure release position is disposed in a position facing the base end portion of the corresponding movable member 52. For this reason, the movable members 52 are moved toward the rotary member 48 by the magnetic force of the magnets 48*e*. Therefore, each sealing member 51 is separated from the corresponding abutment surface 50*c*, ink flows into the small-diameter hole 50*s* and the channels are put into an open state. In other words, the channels can be opened simply by unidirectionally inserting the ink cartridge 14.

Further, because the attached ink cartridge 14 is supported by the support members 30, lead-in support portion 31, and abutment surface 36 connected to the connection portion 41 side, a force acting on the ink cartridge in the tilting direction is reduced and the ink cartridge is fixed in a stable posture. Furthermore, at this time no unnecessary force is applied to the communicating portions 43 and lead-in communicating portion 45 of the connection portion 41.

The first embodiment makes it possible to obtain the following effects.

(1) In the first embodiment, the support portions 30 for supporting the ink lead-out members 29 of the ink packs 25 are formed at the front surface 26*c* of the ink cartridge 14 detachably attached to the printer body 11. Furthermore, the lead-in support portion 31 for leading the ink into the waste ink accommodation portion 27 is formed at one end portion side from the support portions 30. An abutment surface 36 which abuts against the level 40 for opening and closing the ink channels 46 according to the attachment and detachment of the ink cartridge 14 is formed in the end portion opposite the end portion where the lead-in support portion 31 is provided. Further, when the ink cartridge 14 is attached, this abutment surface 36 abuts against the lever 40 to put the channel valves 42 in an open state, thereby opening the ink channels 46. Further, when the ink cartridge 14 is removed, the abutment surface 36 and lever 40 are separated, thereby closing the ink channels 46.

In other words, because the abutment surface 36 for abutting against the lever 40 is provided in the ink cartridge 14, the ink channels 46 can be opened and closed by attaching and detaching the ink cartridge 14. Therefore, when the ink cartridge 14 is not attached to the printer body 11, the ink channels 46 are maintained in a closed state. Therefore, the ink can be prevented from leaking from the communicating portions 43. Furthermore, when the ink cartridge 14 is removed, the ink remains inside the ink channels 46, but because the channel valves 42 are closed in this state, the evaporation of the ink solvent present inside the ink channels 46 can be prevented.

Furthermore, because the ink cartridge 14 fixed to the connection portion 41 is supported by the support portions 30, lead-in support portion 31, and abutment surface 36, the ink cartridge can be fixed in a stable posture, without generating an unnecessary force along the entire region of the connection portion 41. Further, the application of an unnecessary force to the communicating portions 43 and lead-in communicating portion 45 of the connection portion 41 is also prevented.

(2) In the first embodiment, the abutment surface 36 and the lead-in support portion 31 are so formed that the abutment surface 36 and the lead-in support portion 31 are at almost the same height when the ink cartridge 14 is fixed to the connection portion 41. For this reason, when the ink cartridge 14 is attached, the abutment surface 36 abuts against the lever 40 and the direction of the force causing the lever 40 to rotate almost coincides with the direction of force acting to insert the lead-in communicating portion 45 into the lead-in support portion 31. Therefore, when the ink cartridge 14 is attached, a force may be applied in one direction and the ink cartridge can be easily attached.

(3) In the first embodiment, the ink cartridge 14 is provided with the first fitting hole 34 and second fitting hole 34. Furthermore, those first fitting hole 34 and second fitting hole 35 are formed in positions such that the first protrusion 44*a* and second protrusion 44*b* provided in the connection portion 41 can be inserted into the respective fitting holes when the ink cartridge 14 is attached. For this reason, when the ink cartridge 14 is attached, the alignment thereof with respect to the printer body is conducted with the first fitting hole 34 and second fitting hole 35. Therefore, the alignment can be carried out with good precision. Furthermore, because the second fitting hole 35 is provided in the vicinity of the abutment surface 36, the alignment of the abutment surface 36 can be accurately conducted. Therefore, because the operation of abutting the abutment surface 36 against the lever 40 can be conducted with good stability, the reliability of the opening-closing operation of the channel valves 42 can be increased.

(4) In the first embodiment, the substrate accommodation portion 38 that is open at the side of the lower surface 26*b* and at the side of the front surface 26*c* is provided in the lower surface 26*d* of the end portion of the ink cartridge 14 where the abutment surface 36 is formed. Further, the circuit substrate 37 comprising a semiconductor storage device that stores information relating to the ink cartridge 14 is provided in the substrate accommodation portion 38. Therefore, because the printer can acquire the information relating to the ink cartridge 14 when the ink cartridge 14 is attached, control of the ink cartridge 14 or ink can be carried out efficiency. Furthermore, because the substrate accommodation portion 38 is open at the side of the lower surface 26*d* and at the side of front surface 26*c*, the terminal arrangement portion 41*b* of the connection portion 41 can be easily inserted.

(5) In the first embodiment, the front surface of the support portions 30 and lead-in support portion 31 protrudes beyond the front surface 26*c* of the case body 26*a*. For this reason, the abutment surface 36 can be abutted against the protrusion 40*d* of the lever 40 after the communicating portions 43 and laid-in communicating portion 45 are inserted into the support portions 30 and lead-in support portion 31 and the posture of the ink cartridge 14 is stabilized. As a result, the abutment surface 36 can be reliably abutted against the protrusion 40*d* of the lever 40.

Second Embodiment

Figure 13:
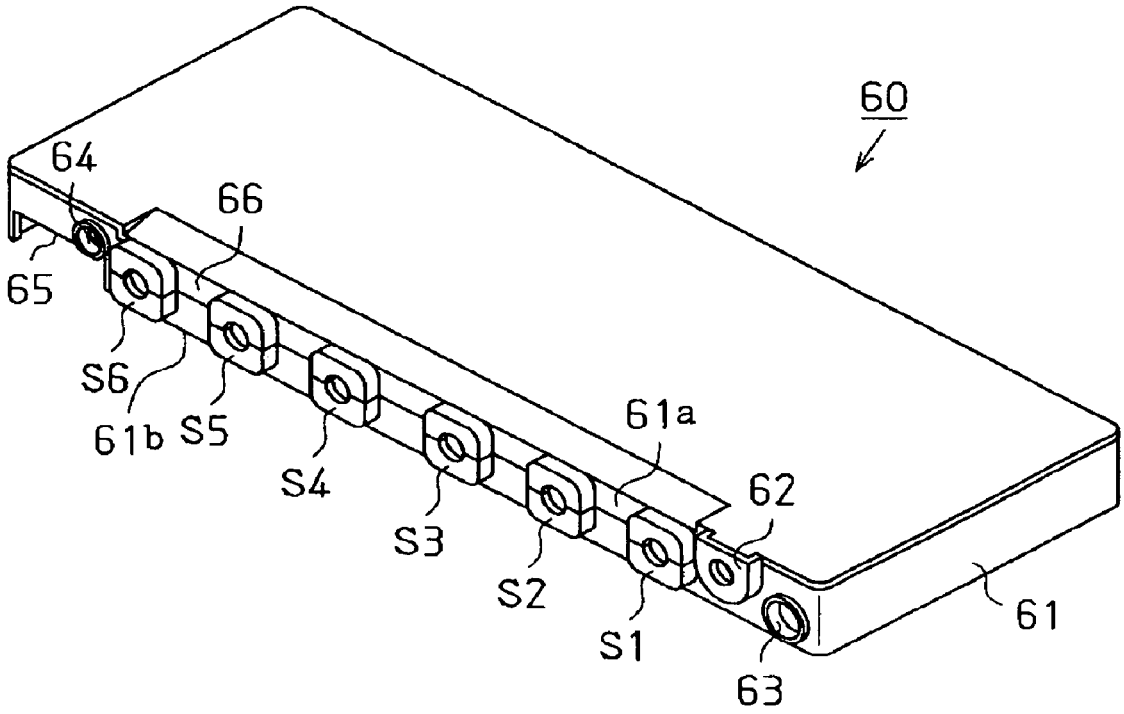
FIG. 13 is a perspective view of the ink cartridge of the second embodiment.
Figure 14:
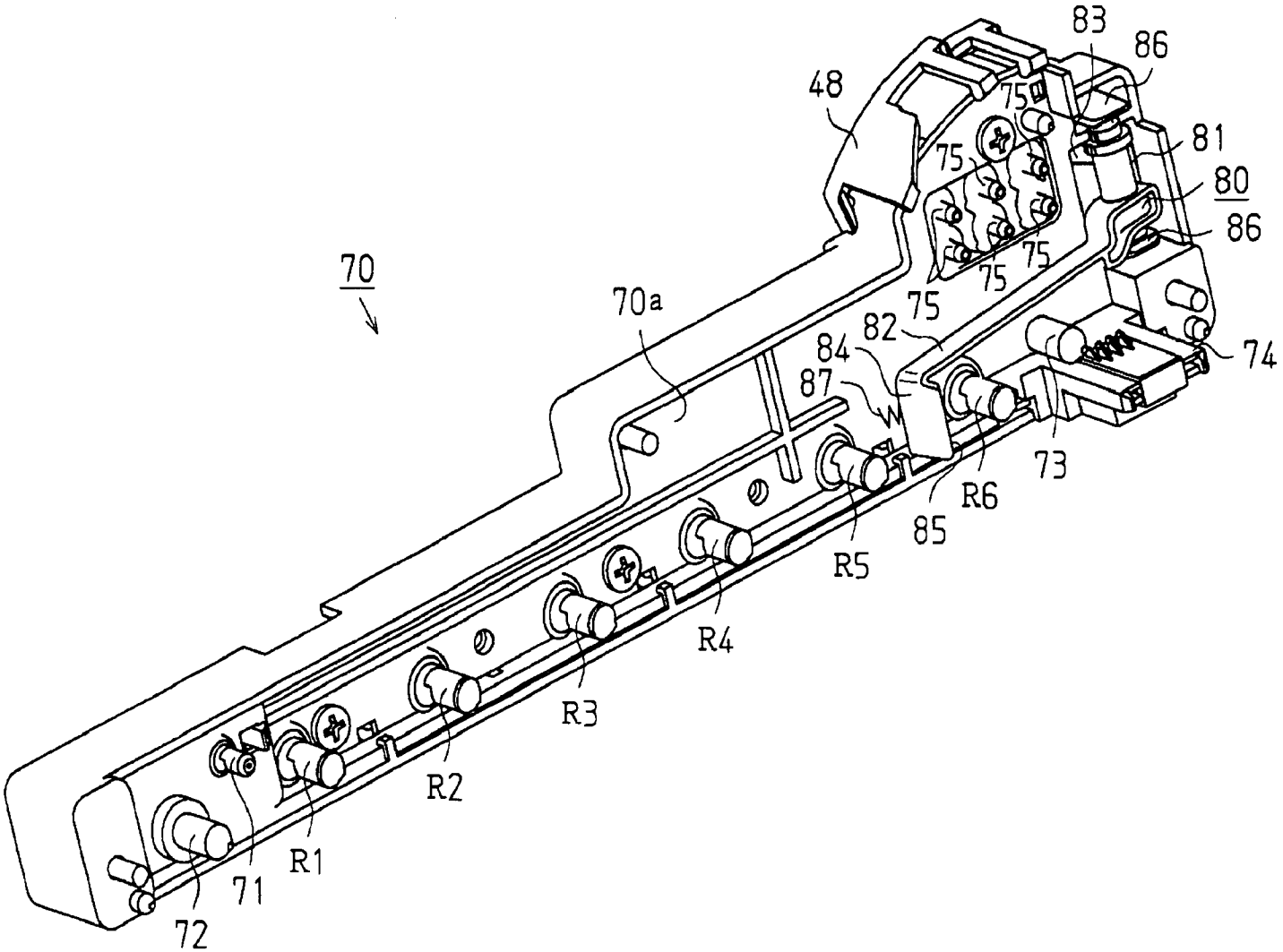
FIG. 14 is a perspective view of the connection portion of the second embodiment.
Figure 15:
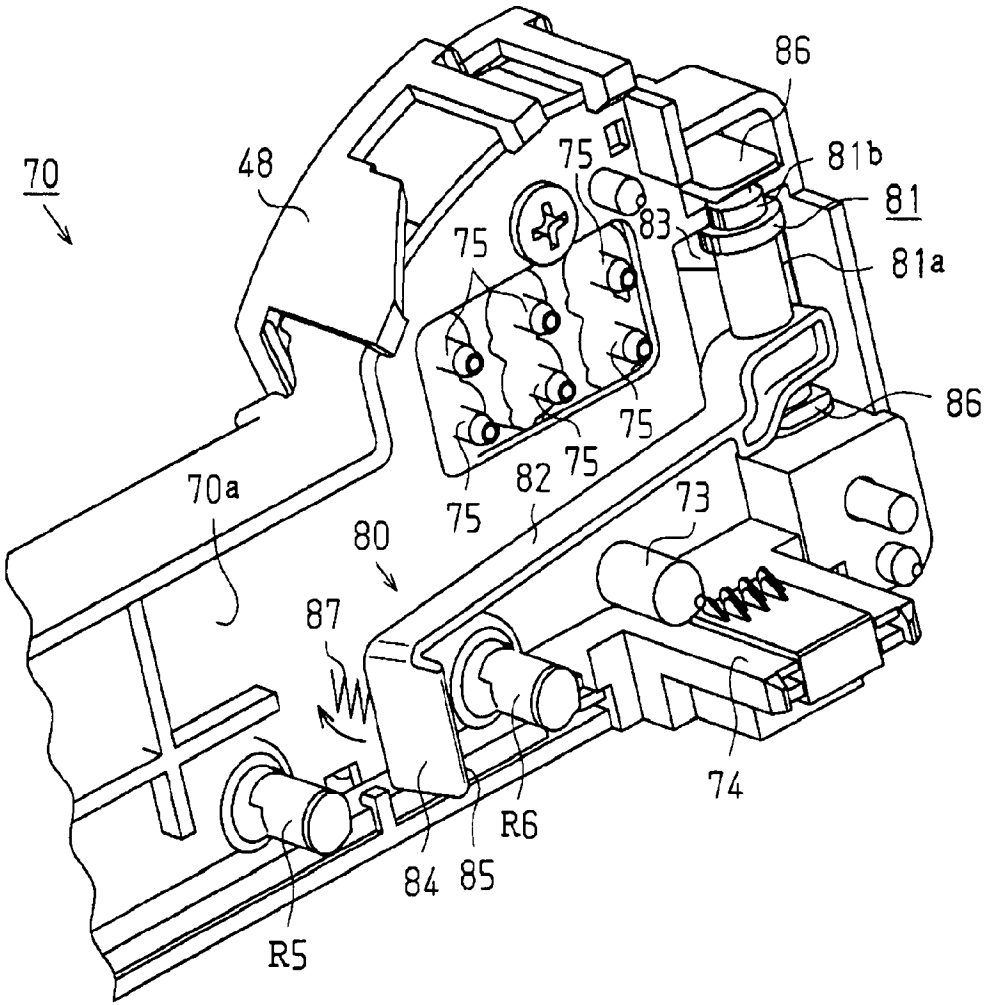
FIG. 15 is a perspective view of the main part of the connection portion.
Figure 16:
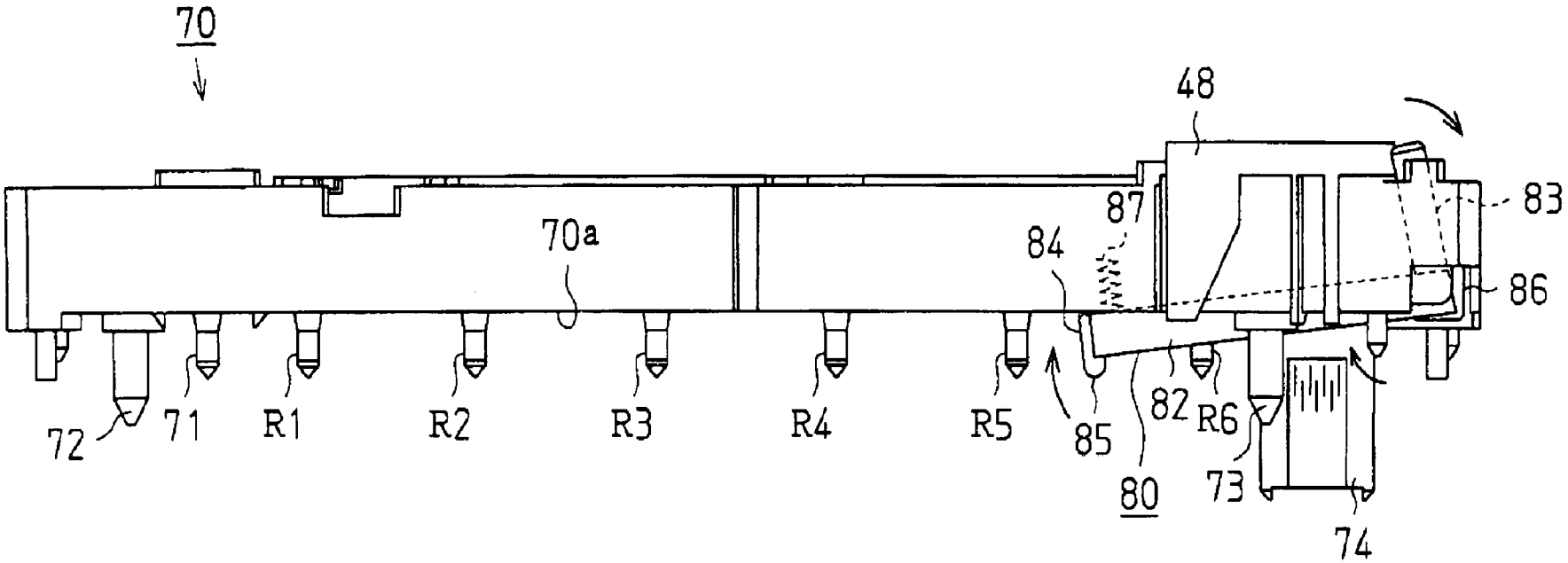
FIG. 16 is a plan view of the connection portion prior to connection of the ink cartridge of the second embodiment.
Figure 17:
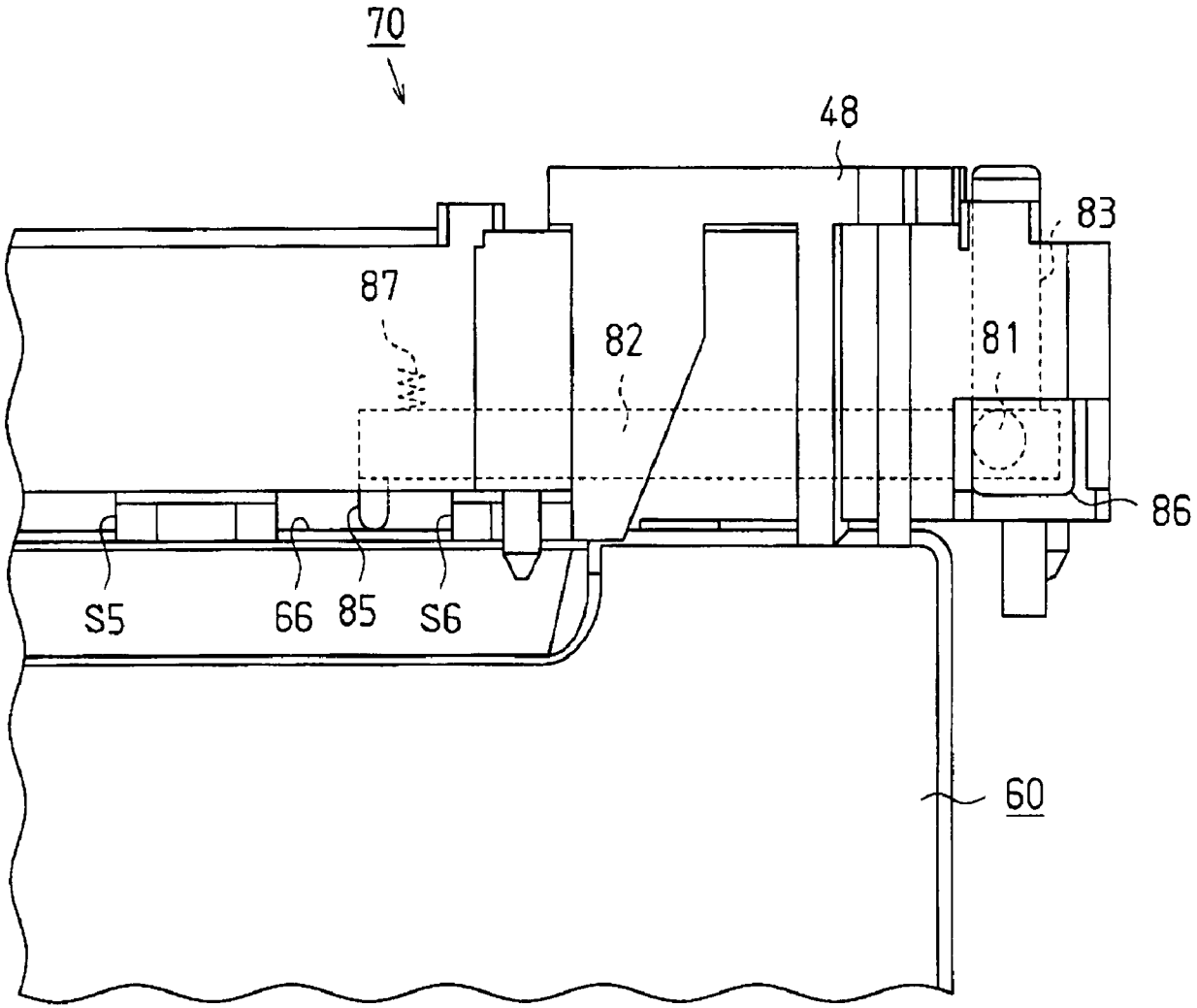
FIG. 17 is a plan view of the main part of the connection portion to which the ink cartridge of the second embodiment has been connected.

The second embodiment of the present invention will be described hereinbelow with reference to FIGS. 13 to 17. In the second embodiment, only parts of the abutment surface 36 and connection portion 41 of the ink cartridge 14 of the first embodiment are changed. Therefore detailed explanation of similar parts is herein omitted. FIG. 13 is a perspective view of an ink cartridge 60 of the second embodiment. FIG. 14 and FIG. 15 are a perspective view of the entire connection portion 70 of the second embodiment and a perspective view of the main part thereof. FIG. 16 is a plan view of the connection portion 70 prior to attaching the ink cartridge 60. FIG. 17 is a plan view of the main part of the connection portion 70 with the ink cartridge 60 attached thereto.

As shown in FIG. 13, a total of six support portions S1-S6 constituting liquid lead-out ports are provided in a front surface 61*a* of an accommodation case 61 constituting the ink cartridge 60. Further, in the front surface 61*a*, a lead-in support portion 62 constituting the liquid lead-in port are formed in the end portion of the support portion S1 at the right end, as shown in FIG. 13. Further, a first fitting hole 63 serving as an aligning hole is formed further closer to the end portion from the lead-in support portion 62 in the front surface 61*a* of the accommodation case 61. The front surface 61*a* of the accommodation case 61 constitutes the connection surface for connection to the side of the printer body 11.

Further, a second fitting hole 64 serving as an aligning hole is formed in the vicinity of the support portion S6 at the left end, as shown in FIG. 13, in the front surface 61*a* of the accommodation case 61. A substrate accommodation portion 65 for accommodating the circuit substrate 37 (see FIG. 3) is provided in the form of a recess in the lower surface 61*b* of the accommodation case 61.

Furthermore, an abutment surface 66 is provided in the front surface 61*a* of the accommodation case 61 between the support portion S6 at the left end thereof and the adjacent support portion S5. In other words, the abutment surface 66 is part of the front surface 61*a* of the accommodation case 61, which is located between the support portion S6 and the adjacent support portion S5.

The connection portion will be described below with reference to FIG. 14 to FIG. 17. As shown in FIG. 14, the connection portion 70 has a lead-in communicating portion 71, which is provided in the connection surface 70*a* used for fixing the front surface 61*a* of the ink cartridge 60. This lead-in communicating portion 71 is inserted into the lead-in support portion 62 of the ink cartridge 70. Furthermore, a first and second protrusions 72, 73 serving as aligning convex portions corresponding to the first and second fitting holes 63, 64, respectively, of the ink cartridge 60 are formed in the aforementioned connection surface 70*a*. Further, a terminal arrangement portion 74 is provided below the second protrusion 73. FIG. 14 shows only the main part of the connection portion 70.

Further, a total of six communicating portions R1-R6 are provided in a protruding condition between the first and second protrusions 72, 73. The communicating portions R1-R6 correspond to respective support portions S1-S6 of the ink cartridge 60 and are inserted into the support portions S1-S6 when the ink cartridge 60 is attached to the connection portion 70. Furthermore, a total of six lead-out portions 75 are formed in the end portion of the connection surface 70*a*. The lead-out portions 75 are formed to be hollow and communicate with the holes of the communicating portions R1-R6 via the ink channels (not shown in the figure).

A channel valve (see FIG. 12) is provided in each of ink channels communicating the communicating portions R1-R6 with the respective lead-out portions 75. A rotary member 48 for opening and closing the channel valves 42 and a lever 80 are attached to the connection portion 70. The lever 80 is disposed at the right end (as shown in FIG. 14) of the connection portion 70.

As shown in FIG. 15, the lever 80 includes a shaft portion 81, an actuation piece 82, and a driven piece 83. The shaft portion 81 is made up of a circular columnar portion 81*a* and a flat plate portion 81*b* formed in the end part of the circular columnar portion 81*a*. The flat plate portion 81*b* is made up of two disk portions. The actuation piece 82 is connected to this shaft portion 81. The actuation piece 82 is formed to have an almost L-like shape, and the distal end of the bent part thereof constitutes an abutment portion 84. A protrusion 85 is formed at the distal end of the abutment portion 84.

Furthermore, the driven piece 83 is coupled to the shaft portion 81. This driven piece 83 is formed to have an almost circular columnar shape, as shown in FIG. 16. Furthermore, as shown in FIG. 16 and FIG. 17, the driven piece 83 is coupled to the shaft portion 81 so that the longitudinal direction of the driven piece and the longitudinal direction of the actuation piece 82 form an angle of almost 90°. Furthermore, as shown in FIG. 15, a pair of shaft support portions 86 for rotatably supporting the shaft portion 81 are provided in the connection portion 70. As a result, the actuation piece 82 of the lever 80 is so disposed that the longitudinal direction thereof is almost parallel to the longitudinal direction of the connection portion 70. Furthermore, the abutment portion 84 provided at the distal end of the actuation piece 82 is disposed between the communicating portion R6 at the right end (at the side of the shaft support portion 86) and the communicating portion R5 provided adjacently thereto. Further, the driven piece 83 is disposed at the opposite side from the connection surface 70*a*.

Further, a biasing spring 87 (see FIG. 15 and FIG. 16) made up of a compression spring or the like is attached to the actuation piece 82. When no external force is applied to the lever 80, the biasing spring 87 biases the actuation piece 82, as shown in FIG. 16, in the direction opposite that toward the connection surface 70*a* of the connection portion 70 and places the lever 80 into the rotation start position. Thus, when the ink cartridge 60 is not attached to the connection portion 70, the lever 80 does not receive a force from the outside. Therefore, it is disposed in a rotation start position, as shown in FIG. 16. Furthermore, because the lever 80 is disposed in a rotation start position, the driven piece 83 applies pressure (see FIG. 9) to one side of the rotary member 48 against the biasing force of the biasing spring 48*f* (see FIG. 9). As a result, the channel valves 42 are maintained in a closed state, as was described hereinabove.

If the ink cartridge 60 is inserted in the cartridge accommodation portion 13, the lever 80 is rotated by the abutment of the abutment surface 66 and the protrusion 85 of the lever 80. More specifically, as shown in FIG. 17, the protrusion 85 of the lever 80 abuts against the abutment surface 66 of the accommodation case 61. If the ink cartridge 60 is further pushed toward the connection portion 70, the protrusion 85 of the lever 80 is pressed against the connection surface 70*a*. If the protrusion 85 is pushed, the actuation piece 82 rotates in the direction shown by an arrow in FIG. 15 and FIG. 16 against the biasing force of the biasing spring 87. Furthermore, the driven piece 83 rotates in the direction shown by an arrow in FIG. 16 by the rotation of the shaft portion 81. At this time, since the actuation piece 82 is comparatively long, the lever 80 can be rotated with a small push-in force.

If the ink cartridge 60 moves to the connection portion 70, the first and second protrusions 72, 73 are inserted in the first and second fitting holes 63, 64 of the ink cartridge 60. Then, the lead-in communicating portion 71 and the communicating portions R1-R6 that have the same length and are formed to be shorter in the cartridge insertion direction than the first and second protrusions 72, 73 are inserted into the support portions S1-S6 and lead-in support portions 62 of the ink cartridge 60, respectively, and thereafter the protrusion 85 of the lever 80 abuts against the abutment surface 66 of the cartridge. As a result, the lever 80 is disposed in a rotation end portion and the driven piece 83 is put into a state in which it does not apply pressure to the rotary member 48 (see FIG. 11). As a result, as described hereinabove, the channel valves 42 are put into an open state and the ink present inside the ink cartridge 60 can be led out from the lead-out portions 75 via the connection portions R1-R6.

Therefore, with the second embodiment, the following effects can be obtained in addition to the effects (3)-(5) described in the first embodiment.

(6) In the second embodiment, a total of six support portions S1-S6 are provided at the front surface 61*a* of the ink cartridge 60. Furthermore, the abutment surface 66 for abutting against the lever 80 when the ink cartridge 60 is attached to the connection portion 70 is provided between the support portion S6 disposed at the side of the rotary shaft (shaft portion 81) of the lever 80 and the support portion S5 located adjacently thereto. In other words, the position of the abutment surface 66 is provided between the support portions S6, S5, rather than at the end of the ink cartridge 60. Therefore, the abutment surface can also abut against the lever 80 having a comparatively long actuation piece 82. Therefore, when the ink cartridge 60 is inserted, the lever 80 can be rotated and the channel valves 42 can be open with a comparatively small pushing force. Furthermore, when the ink cartridge 60 is detached, the channel valves 42 can be closed by separating the abutment surface 66 and lever 80. For this reason, when the ink cartridge 60 is not attached to the printer body 11, the ink channels 46 in the connection portion 70 is maintained in a closed state. Therefore, the ink can be prevented from leaking from the communicating portions R1-R6. Furthermore, after the ink cartridge 60 has been detached, the ink remains inside the ink channels 46 in the connection portion 70, but because the channel valves 42 are closed in this state, the evaporation of ink solvent present in the ink channels 46 can be prevented. Furthermore, the reliability of rotation operation of the lever 80 can be increased by forming a flat and smooth abutment surface 66.

The present embodiments may be modified in the manner as follows.

In the above-described embodiments, the cartridge accommodation portion 13 is provided inside the frame 12, but it may be also provided in other places. For example, it may be installed inside the outer case, but outside the frame 12, or outside the outer case. Furthermore, a cartridge accommodation portion 13 may be so provided that the ink cartridge 14 is attached with the lid portion 26*b* extending in the perpendicular direction In the second embodiment, the abutment surface 66 is provided between the support portion S6 provided at the very end in the accommodation case 61 and the support portion S5 adjacent thereto. Opening and closing the liquid channels can be also conducted by providing the abutment surface between other support portions S1-S5.

In the second embodiment, the substrate accommodation portion 65 may be provided in a position other than that below the second fitting hole 64, such as a position below the abutment surface 66, in the lower surface 61*b* of the accommodation case 61.

In the above-described embodiments, the front surface of the support portions 30, S1-S6 and lead-in support portion 31, 62 protrude beyond the front surface 26*c*, 61*a* of the accommodation case 26, 61, but the front surface of the support portions 30, S1, S6 also may be at the same height with the front surface 26*c*, 61*a*.

Figure 18:
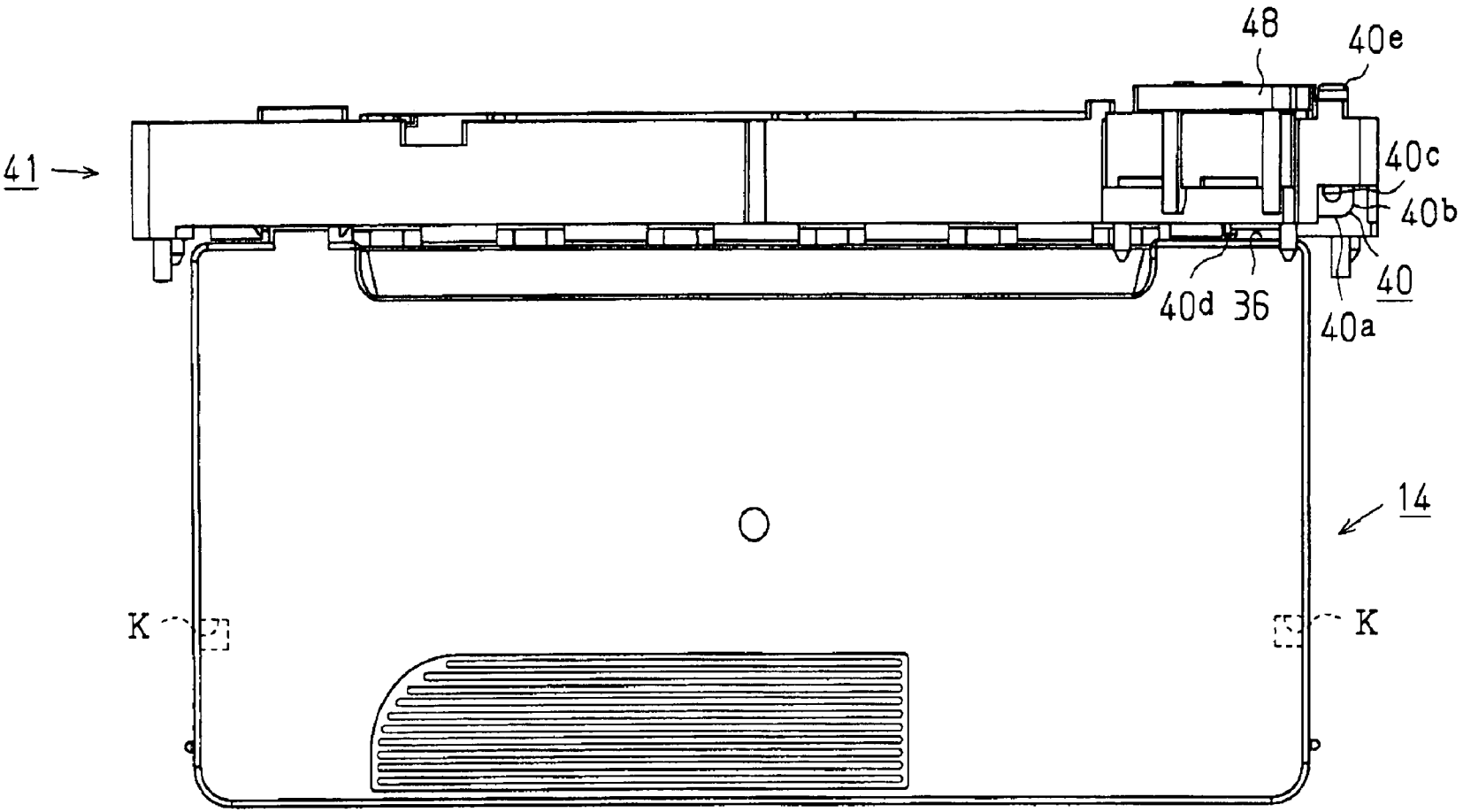
FIG. 18 is a plan view of the connection portion to which an ink cartridge of another example has been attached.

In the above-described embodiments, a member for applying a pressure in the direction from the surface opposite the connection surface toward the connection surface, or an engagement concave portion K for engaging with a member for fixing the cartridge in a connected state thereof, as shown in FIG. 18, can be also provided in order to maintain the connection state with the ink cartridge. In this case, balanced fixing can be also carried out after the insertion, if the aforementioned members or portions are respectively disposed on opposite side walls intersecting the connection surface and at positions proximate the liquid lead-in port and the abutment surface, and are distanced by the same length from the connection surface.

In the above-described embodiments, the explanation is conducted with respect to a printer for discharging ink, as a liquid ejection device, but other liquid ejection devices are also possible. For example, printing devices such as faxes and copiers, liquid ejection devices for ejecting liquids such as colorants or electrode materials which are used in the manufacture of liquid-crystal displays, EL displays, and flat-panel light-emitting displays, liquid ejection devices for ejecting bioorganic substances which are used in the manufacture of biochips, and sample ejection devices as precision pipettes may be also used. The fluid (liquid) is not limited to inks, and other fluids may be also employed.

What is claimed is:

1. A liquid container containing a liquid therein and configured to be detachably mountable to a liquid ejection apparatus, the liquid container comprising:

a front wall elongated in a first direction;

at least one liquid supplying port configured to supply said liquid to the outside of the liquid container and disposed on the front wall;

a liquid lead-in port configured to receive a lead-in communicating portion provided in said liquid ejection apparatus and disposed in a position closer to a first end of the front wall in the first direction; and an abutment surface configured to abut against a part of a channel valve provided in said liquid ejection apparatus and disposed in a position closer to a second end of the front wall in the first direction.

2. The liquid container according to claim 1, wherein:

said at least one liquid supplying port includes a plurality of liquid supplying ports; and said abutment surface is provided adjacent to one of said liquid supplying ports.

3. The liquid container according to claim 1, wherein:

said liquid supplying port is configured to receive a communicating portion provided in said liquid ejection apparatus; and said abutment surface lies in a plane perpendicular to an insertion direction of said communicating portion into said liquid supplying port.

4. A liquid container containing a liquid therein and configured to be detachably mountable to a liquid ejection apparatus, the liquid container comprising:

a front wall;

at least one liquid supplying port configured to receive a communicating portion provided in said liquid ejection apparatus and disposed on the front wall;

a plurality of fitting holes configured to receive a plurality of protrusions provided in said liquid ejection apparatus and disposed on the front wall; and an abutment surface configured to abut against a part of a channel valve provided in said liquid ejection apparatus and disposed on the front wall, wherein:

the liquid supply port and the abutment surface are disposed between the fitting holes.

5. The liquid container according to claim 4, further comprising:

a liquid lead-in port configured to receive a lead-in communicating portion provided in said liquid ejection apparatus, and disposed in a position closer to one end of the front wall than one of the fitting holes.

6. The liquid container according to claim 4, wherein:

said at least one liquid supplying port includes a plurality of liquid supplying ports; and said abutment surface is provided adjacent to one of said liquid supplying ports.

* * * * *